United States Patent [19]

Sawada et al.

[11] Patent Number: 4,614,702

[45] Date of Patent: Sep. 30, 1986

[54] HEAT-DEVELOPABLE COLOR PHOTOGRAPHIC MATERIAL WITH MERCAPTO ANTIFOGGANT

[75] Inventors: Satoru Sawada; Yoshiharu Yabuki, both of Kanagawa, Japan

[73] Assignee: Fuji Photo Film Co., Ltd., Kanagawa, Japan

[21] Appl. No.: 701,483

[22] Filed: Feb. 14, 1985

Related U.S. Application Data

[63] Continuation-in-part of Ser. No. 561,710, Dec. 15, 1983, abandoned.

[30] Foreign Application Priority Data

Dec. 17, 1982 [JP] Japan ..... 57-222247

[51] Int. Cl.[4] ..... G03C 5/54; G03C 1/40; G03C 1/34

[52] U.S. Cl. ..... 430/203; 430/216; 430/219; 430/351; 430/617; 430/619; 430/372; 430/611

[58] Field of Search ..... 430/203, 219, 218, 216, 430/223, 351, 372, 551, 611, 617, 619, 559

[56] References Cited

U.S. PATENT DOCUMENTS

| | | | |
|---|---|---|---|
| 3,226,231 | 12/1965 | Dersch et al. | 430/611 |
| 3,244,522 | 4/1966 | Clementi et al. | 430/611 |
| 3,650,760 | 3/1972 | Gates et al. | 430/611 |
| 4,430,415 | 2/1984 | Aano et al. | 430/203 |
| 4,500,626 | 2/1985 | Naito et al. | 430/203 |

OTHER PUBLICATIONS

Carpenter et al, "Photothermographic Silver Halide Systems," *Research Disclosure,* No. 17029, 6/1978, pp. 9–15.

*Primary Examiner*—Richard L. Schilling

*Attorney, Agent, or Firm*—Sughrue, Mion, Zinn, Macpeak, and Seas

[57] ABSTRACT

A heat-developable color photographic material comprising a support having thereon at least a light-sensitive silver halide, a hydrophilic binder, a dye releasing redox compound capable of releasing a hydrophilic dye and a compound represented by the following general formula (IIA):

(IIA)

wherein B represents an alkyl group or a substituted alkyl group; m represents 0 or an integer of 1 to 4; and A represents an alkyl group, an aryl group, a cycloalkyl group, an aralkyl group, an alkoxy group, an aryloxy group, an alkylthio group, an arylthio group, an acyl group, an alkoxycarbonyl group, an amino group, an N-substituted amino group, an acylamino group, a carbamoyl group, an N-substituted carbamoyl group, an alkylsulfonyl group, an arylsulfonyl group, an alkylsulfonylamino group, an arylsulfonylamino group, a sulfamoyl group, an N-substituted sulfamoyl group, a cyano group, a hydroxy group, a nitro group or a halogen atom and when m represents 2 or more A may be the same or different.

A method of forming a color image is also disclosed which comprises imagewise exposing a heat-developable color photographic material comprising a support having thereon a light-sensitive silver halide, a hydrophilic binder, a dye releasing redox compound capable of releasing a hydrophilic dye and a compound represented by general formula (IIA).

22 Claims, No Drawings

HEAT-DEVELOPABLE COLOR PHOTOGRAPHIC MATERIAL WITH MERCAPTO ANTIFOGGANT

CROSS REFERENCE TO RELATED APPLICATION

The present application is a continuation-in-part of U.S. Ser. No. 561,710 filed Dec. 15, 1983, now abandoned having the same title and inventors as the present application. It is now abandoned.

FIELD OF THE INVENTION

The present invention relates to a process of forming a color image by heat-development and a heat-developable color photographic material used therein. Particularly, the present invention relates to a novel process for obtaining a color image by diffusion transfer of a dye released upon heat-development into a support having a mordant layer in a heat-developable color photographic material containing a dye releasing redox compound which releases a hydrophilic diffusible dye upon heat-development and a heat-developable color photographic material used therein.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of easily and quickely obtaining images have been developed by changing the conventional wet process using a developing solution into a dry development process such as a process using heat, etc.

Heat-developable photographic materials are known in the field of these techniques. Heat-developable photographic materials and processes therefor have been described in U.S. Pat. Nos. 3,152,904, 3,301,678, 3,392,020 and 3,457,075, British Patent Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Patent No. 802,519 and *Research Disclosure,* pages 31 and 32 (Sept., 1975) and the combination of a sulfonamidophenol type reducing agent and a 4-equivalent coupler as described in U.S. Pat. No. 4,021,240. These processes, however, are disadvantageous in that turbid color images are formed, because a reduced silver image and a color image are simultaneously formed on the exposed area after heat-development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat-development has been described in *Research Disclosure,* No. 16966, pages 54 to 58 (May, 1978). According to this process, clear images cannot be obtained, because it is difficult to control the release of dyes from nonexposed areas, and thus it is not a conventionally applicable process.

Also, processes for forming a positive color image by a silver dye bleach process utilizing heat, with useful dyes and methods for bleaching have been described, for example, in *Research Disclosure,* No. 14433, pages 30 to 32 (April, 1976), ibid., No. 15227, pages 14 and 15 (Dec., 1976) and U.S. Pat. No. 4,235,957.

However, this process requires an additional step and an additional material for accelerating bleaching of dyes, for example, heating with a superposed sheet with an activating agent. Furthermore, it is not desirable because the resulting color images are gradually reduced and bleached by coexisting free silver during long periods of preservation.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

Furthermore, these processes described above generally have disadvantages that only color images having a high level of fog and a low density are obtained.

SUMMARY OF THE INVENTION

The present invention provides a novel process for forming a color image by heat-development and a heat-developable color photographic material used therein, eliminating the drawbacks present in known materials.

Therefore, an object of the present invention is to a provide a process for obtaining a color image having not only a high density but also a low level of fog by heat development and a heat-developable color photographic material used therein.

Another object of the present invention is to provide a novel process for forming an image which comprises transferring a dye released upon heat-development into an image receiving material containing a mordant to obtain a color image having a low level of fog and a heat-developable color photographic material used therein.

Further object of the present invention is to provide a novel process for forming an image which comprises heat transferring a dye released upon heat-development into an image receiving material containing a mordant to obtain a color image having a low level of fog and a heat-developable color photographic material used therein.

A still further object of the present invention is to provide a process for obtaining a clear color image by a simple procedure and a heat-developable color photographic material used therein.

An even further object of the present invention is to provide a process for obtaining a color image which is stable for a long period of time and a heat-developable color photographic material used therein.

These and other objects of the present invention will become more apparent from the following detailed description and examples.

These object of the present invention are accomplished with a heat-developable color photographic material comprising a support having thereon at least a light-sensitive silver halide, a hydrophilic binder, a dye releasing redox compound capable of releasing a hydrophilic dye and a compound represented by the following general formula (I):

$$Ro—SM \quad (I)$$

wherein Ro represents an alkyl group, a cycloalkyl group, an aralkyl group, an alkenyl group or an aryl group and each of these groups may further have one or more substituents; and M represents a hydrogen atom, a silver atom, an alkali metal atom or an ammonium group.

DETAILED DESCRIPTION OF THE INVENTION

The compounds represented by the general formula (I) according to the present invention are described in detail below. Examples of the substituents for the group represented by Ro include, for example, an alkyl group, an aryl group, a cycloalkyl group, an aralkyl group, an alkoxy group, an aryloxy group, an alkylthio group, an arylthio group, an acyl group, an alkoxycarbonyl group, an amino group, an N-substituted amino group, an acylamino group, a carbamoyl group, an N-substituted carbamoyl group, an alkylsulfonyl group, an arylsulfonyl group, an alkylsulfonylamino group, an arylsulfonylamino group, a sulfamoyl group, an N-substituted sulfamoyl group, a cyano group, a hydroxy group, a nitro group, a halogen atom, etc.

Of these substituents, an alkyl group, an alkoxy group, an aryloxy group, an alkoxycarbonyl group, an acylamino group, a sulfonylamino group and a halogen atom are preferred.

In the general formula (I), M preferably represents a hydrogen atom or a silver atom.

Of the compounds represented by the general formula (I), those having a high hydrophobic property are particularly effective for the purpose of controling the fog. In order to obtain the sufficiently high hydrophobic property, it is desirable that the total number of the carbon atoms included in the compound is not less than 6, and preferably, not less than 8.

More preferred compounds according to the present invention are those represented by the following general formula (II):

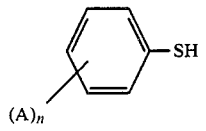

(II)

wherein n represents 0 or an integer of 1 to 5; A represents the substituent for the group represented by Ro in the general formula (I) and when n represents 2 or more A may be the same or different.

Even more preferred compounds within those represented by general formula (II) are those represented by general formula (IIA) below:

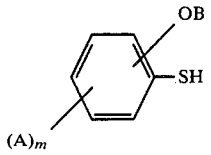

(IIA)

wherein B represents an alkyl group or a substituted alkyl group which can be ortho-, meta- or para- the SH group; A has the same meaning defined above; and m represents 0 or an integer 1 to 4 and when m represents 2 or more A may be the same or different.

Thus, $R_0$ can represent an alkyl group which has 1 or more substituents, a cycloalkyl group which may have 1 or more substituents, an aralkyl group which may have 1 or more substituents, an alkenyl group which may have 1 or more substituents, or an aryl group which may have 1 or more substituents, etc., all of which may be substituted ortho-, meta- or para- the SH group.

Further, of the compounds represented by the general formula (II), those represented by the general formula (III) below are more particularly preferred.

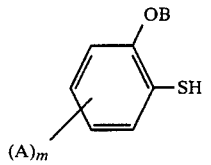

(III)

wherein B represents an alkyl group or a substituted alkyl group; A has the same meaning as defined above; and m represents 0 or an integer of 1 to 4 when m represents 2 or more A may be the same or different.

In the following, specific examples of the effective compounds according to the present invention are set forth, but the present invention is not to be construed as being limited thereto.

$C_{12}H_{25}SH$ (1)

$C_{16}H_{33}SH$ (2)

$C_2H_5NHCOCH_2SH$ (3)

$C_6H_{13}OCH_2CH_2SH$ (4)

$(C_{18}H_{37})_2NCH_2CH_2CH_2SH$ (5)

$C_2H_5SO_2CH_2CH_2SH$ (6)

$C_2H_5O\overset{O}{\overset{\|}{C}}CH_2SH$ (7)

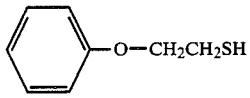

(8)

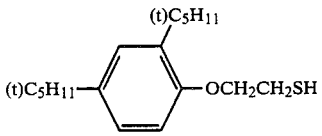

(9)

-continued
(10)
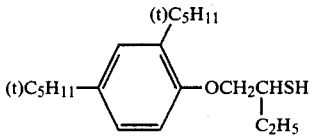
(11)
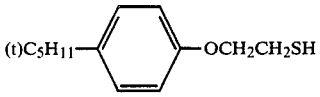
(12)
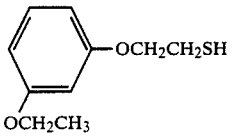
(13)
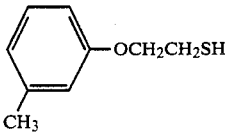
(14)
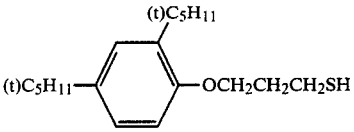
(15)
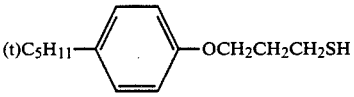
(16)
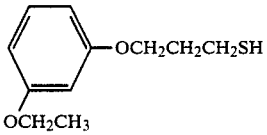
(17)
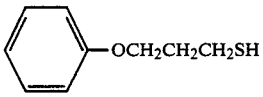
(18)
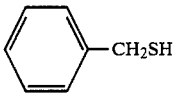
(19)
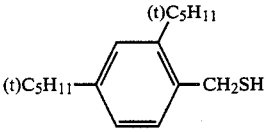
(20)
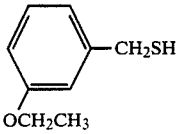
-continued
(21)
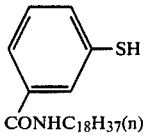
(22)
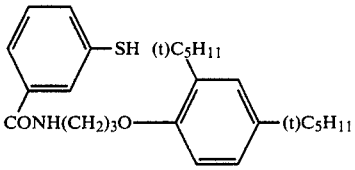
(23)
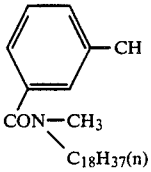
(24)
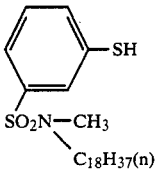
(25)
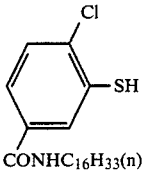
(26)
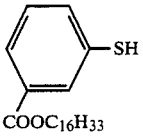
(27)
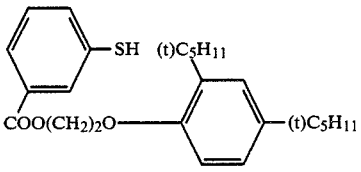
(28)
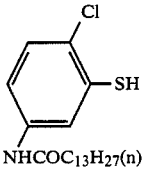
(29)
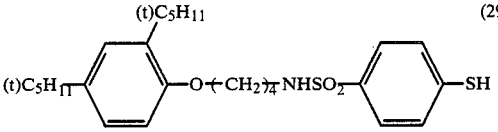

-continued
(30)
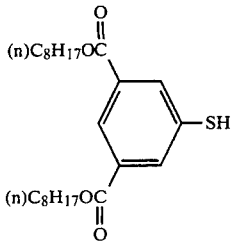
(31)
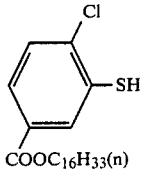
(32)
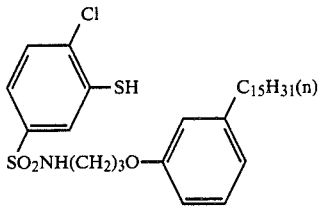
(33)
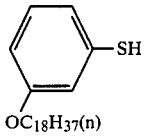
(34)
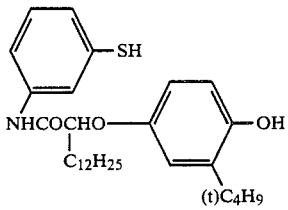
(35)
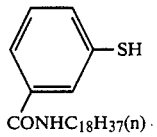
(36)
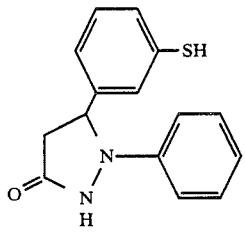
-continued
(37)
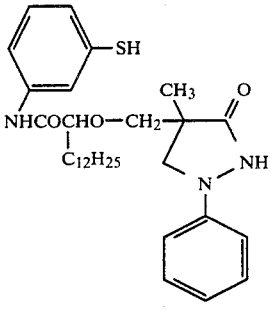
(38)
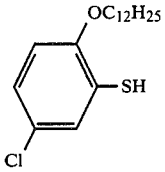
(39)
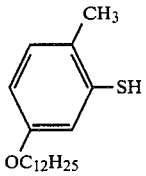
(40)
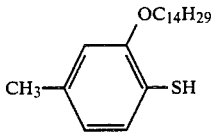
(41)
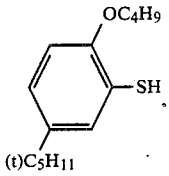
(42)
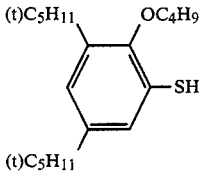
(43)
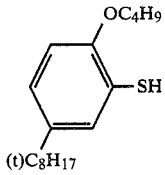
(44)
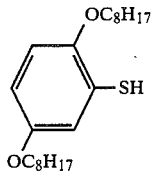

-continued (45)

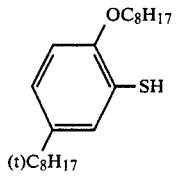

(46)

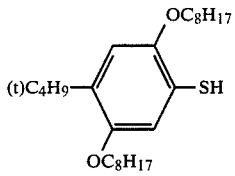

(47)

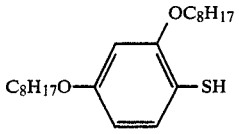

(48)

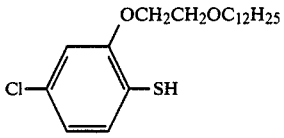

(49)

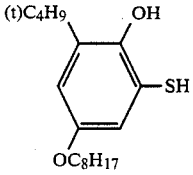

(50)

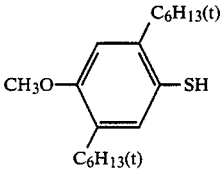

(51)

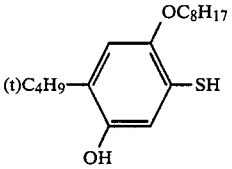

(52)

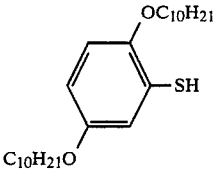

(53)

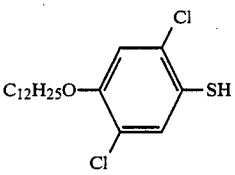

(54)

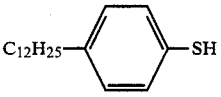

-continued (55)

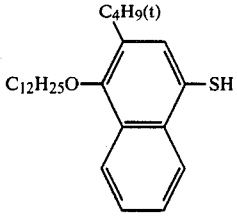

(56) $CH_3CH{=}CH{-}SH$

(57) $C_{12}H_{25}S.Na$

The compounds according to the present invention can be used individually or as a mixture of two or more thereof.

The compound according to the present invention and/or a silver salt thereof can be used in an amount of a broad range. It is used in an amount from 0.001 to 10 mols, and preferably from 0.01 to 2 mols per mol of the silver halide (the total amount of the silver halide and an organic silver salt oxidizing agent when the organic silver salt oxidizing agent is employed).

The compound according to the present invention can be added to a layer by dissolving it in a water-miscible organic solvent (for example, methanol, ethanol, dimethyl formamide, etc.) or by dissolving it in a slightly water-soluble organic solvent (for example, ethyl acetate, tricresyl phosphate, dibutyl phthalate, etc.) and dispersing the solution alone or together with the dye releasing redox compound.

The heat-developable color photographic material of the present invention can simultaneously provide a silver image having a negative-positive relationship to the original and a diffusible dye on the part corresponding to the silver image utilizing only heat-development after imagewise exposure to light. That is, when the heat-developable color photographic material of the present invention is imagewise exposed to light and developed by heating, an oxidation-reduction reaction occurs between an exposed light-sensitive silver halide and a dye releasing redox compound to form a silver image in the exposed area. In this step, the dye releasing redox compound is oxidized by the silver halide to form an oxidized product. This oxidized product is cleaved in the presence of a dye releasing activator and consequently the hydrophilic diffusible dye is released. Accordingly, the silver image and the diffusible dye are formed in the exposed area, and a color image is obtained by transferring the diffusible dye.

The reaction of releasing a diffusible dye according to the present invention is completed with a dry film under high temperature. This releasing reaction of a diffusible dye is believed to be a reaction by the so-called attack with a nucleophilic agent and is usually carried out in a liquid. In the present invention, the compounds which are set forth as preferred examples show a high reaction rate even in the dry film, although the rate varies depending on the kind of dye releasing redox compounds. The reaction rates found were unexpectedly high. Further, the dye releasing redox compound according to the present invention can undergo an oxidation-reduction reaction with silver halide without the assistance of the so-called auxiliary developing agent. This is also an unexpected result based on previous information of what may happen at ambient temperature.

The above described reaction is particularly accelerated in the presence of an organic silver salt oxidizing agent to provide a high color density. Therefore, it is a particularly preferred embodiment in which the organic silver salt oxidizing agent is coexistent.

The dye releasing redox compound which releases a hydrophilic diffusible dye used in the present invention is represented by the following general formula (XI):

$$R—SO_2—D \quad (XI)$$

wherein R represents a reducing group capable of being oxidized by the silver halide; and D represents an image forming dye portion containing a hydrophilic group.

Preferably the reducing group R in the dye releasing redox compound $R—SO_2—D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group include those represented by the following general formulae (XII) to (XIX).

(XII)

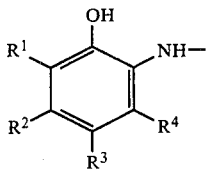

(XIII)

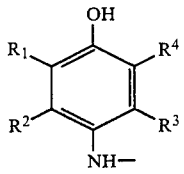

(XIV)

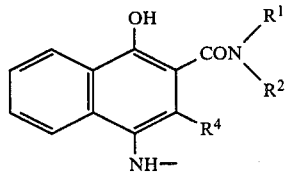

(XV)

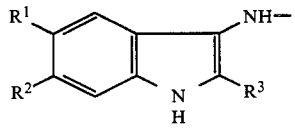

(XVI)

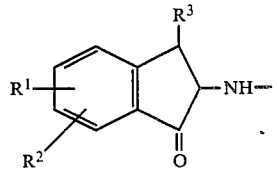

-continued (XVII)

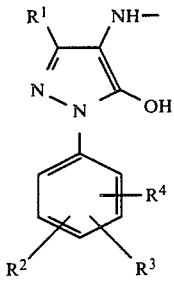

(XVIII)

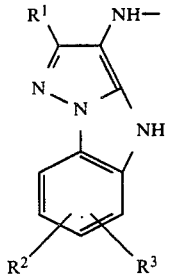

(XIX)

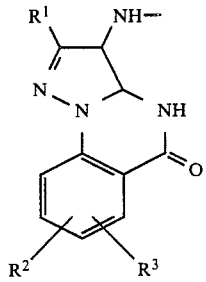

wherein $R^1$, $R^2$, $R^3$ and $R^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. Furthermore, the hydroxy group and the amino group included in the reducing group represented by R may be protected by a protective group capable of reproducing the hydroxy group and the amino group by the action of a nucleophilic agent.

In more preferred embodiments of the present invention, the reducing group R is represented by the following general formula (XX).

(XX)

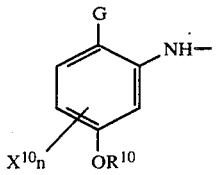

wherein G represents a hydroxy group or a group giving a hydroxy group upon hydrolysis; $R^{10}$ represents an alkyl group or an aromatic group; $X^{10}$ represents an electron donating substituent when n is 1 or substituents, which may be the same or different, one of the substituents being an electron donating group and the second or second and third substituents being selected from an electron donating group or a halogen atom when n is 2 or 3; wherein $X^{10}$ groups may form a condensed ring with each other or with $OR^{10}$; n is 1, 2 or 3 and the total carbon number of $X^{10}_n$ and $R^{10}$ is not less than 8.

Of the reducing groups represented by the general formula (XX), more preferred reducing groups R are represented by the following general formulae (XXa) and (XXb):

(XXa)

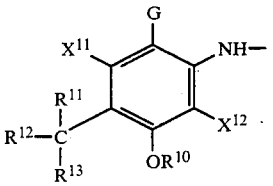

wherein G represents a hydroxy group or a group giving a hydroxy group upon hydrolysis; $R^{11}$ and $R^{12}$, which may be the same or different, each represents an alkyl group or $R^{11}$ and $R^{12}$ may be bonded to each other to form a ring; $R^{13}$ represents a hydrogen atom or an alkyl group; $R^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R^{10}$ and $X^{12}$ or $R^{10}$ and $R^{13}$ may be bonded to each other to form a ring, (XXb)

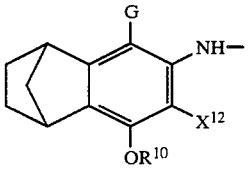

wherein G represents a hydroxy group or a group giving a hydroxy group upon hydrolysis; $R^{10}$ represents an alkyl group or an aromatic group; $X^{12}$ represents a hydrogen atom, an alkyl group, an alkoxy group, a halogen atom, an acylamino group or an alkylthio group; and $R^{10}$ and $X^{12}$ may be bonded to each other to form a ring.

Specific examples of the reducing groups represented by the above described general formulae (XX), (XXa) and (XXb) are described in U.S. Pat. No. 4,055,428 (incorporated herein by reference to disclose such groups), Japanese Patent Application (OPI) Nos. 12642/81 and 16130/81.

In other more preferred embodiments of present invention, the reducing group R is represented by the following general formula (XXI).

(XXI)

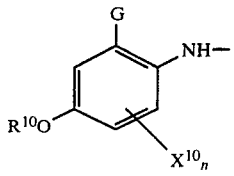

wherein G, $R^{10}$, $X^{10}$ and n each has the same meaning as defined in the general formula (XX).

Of the reducing groups represented by the general formula (XXI), more preferred reducing groups R are represented by the following general formulae (XXIa), (XXIb) and (XXIc)

(XXIa)

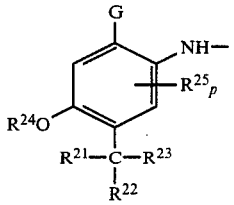

wherein G represents a hydroxy group or a group giving a hydroxy group upon hydrolysis; $R^{21}$ and $R^{22}$, which may be the same or different, each represents an alkyl group or an aromatic group, and $R^{21}$ and $R^{22}$ may be bonded to each other to form a ring; $R^{23}$ represents a hydrogen atom, an alkyl group or an aromatic group; $R^{24}$ represents an alkyl group or an aromatic group; $R^{25}$ represents an alkyl group, an alkoxy group, an alkylthio group, an arylthio group, a halogen atom or an acylamino group; p is 0, 1 or 2; $R^{24}$ and $R^{25}$ may be bonded to each other to form a condensed ring; $R^{21}$ and $R^{24}$ may be bonded to each other to form a condensed ring; $R^{21}$ and $R^{25}$ may be bonded to each other to form a condensed ring; and the total number of the carbon atoms included in $R^{21}$, $R^{22}$, $R^{23}$, $R^{24}$ and $R^{25}_p$ is more than 7.

(XXIb)

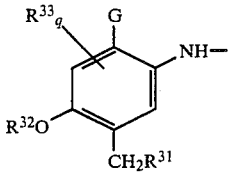

wherein G represents a hydroxy group or a group giving a hydroxy group upon hydrolysis; $R^{31}$ represents an alkyl group or an aromatic group; $R^{32}$ represents an alkyl group or an aromatic group; $R^{33}$ represents an alkyl group, an alkoxy group, an alkylthio group, an arylthio group, a halogen atom or an acylamino group; q is 0, 1 or 2; $R^{32}$ and $R^{33}$ may be bonded to each other to form a condensed ring; $R^{31}$ and $R^{32}$ may be bonded to each other to form a condensed ring; $R^{31}$ and $R^{33}$ may be bonded to each other to form a condensed ring; and the total number of the carbon atoms included in $R^{31}$, $R^{32}$ and $R^{33}_q$ is more than 7.

(XXIc)

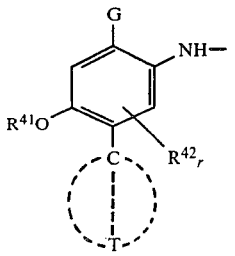

wherein G represents a hydroxy group or a group giving a hydroxy group upon hydrolysis; $R^{41}$ represents a alkyl group or an aromatic group; $R^{42}$ represents an alkyl group, an alkoxy group, an alkylthio group, an arylthio group, a halogen atom or an acylamino group; r is 0, 1 or 2; the group of

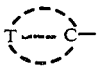

represents a group in which 2 to 4 saturated hydrocarbon rings are condensed, the carbon atom

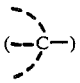

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R^{41}$ or $R^{42}$ and the group of

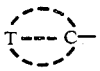

may be bonded to each other to form a condensed ring; and the total number of the carbon atoms included in $R^{41}$, $R^{42}{}_r$ and the group of

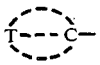

is not less than 7.

Specific examples of the reducing groups represented by the above described general formulae (XXI), (XXIa), (XXIb) and (XXIc) are described in Japanese Patent Application (OPI) Nos. 16131/81, 650/82 and 4043/82.

The essential part in the groups represented by the general formulae (XIII) and (XIV) is a para (sulfonyl-)aminophenol part. Specific examples of these reducing groups are described in U.S. Pat. Nos. 3,928,312 and 4,076,529, U.S. Published patent application B Ser. No. 351,673, U.S. Pat. Nos. 4,135,929 and 4,258,120 (all of which are incorporated herein by reference to disclose such groups). These groups are also effective for the reducing group R according to the present invention.

In still other more preferred embodiments of the present invention, the reducing group R is represented by the following general formula (XXII).

(XXII)

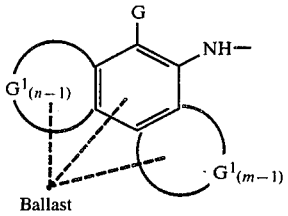

wherein Ballast represents a diffusion-resistant group; G represents a hydroxy group or a precursor of a hydroxy group; $G^1$ represents an aromatic ring directly condensed to the benzene nucleus to form a naphthalene nucleus; and n and m are dissimilar positive integers of 1 to 2.

Specific examples of the reducing groups represented by the above described general formula (XXII) are described in U.S. Pat. No. 4,053,312 (incorporated herein by reference to disclose such groups).

The reducing groups represented by the above described general formulae (XV), (XVII), (XVIII) and (XIX) are characterized by containing a heterocyclic ring. Specific examples of the groups are described in U.S. Pat. Nos. 4,198,235 and 4,273,855 (incoporated herein by reference to disclose such groups), Japanese Patent Application (OPI) No. 46730/78.

Specific examples of the reducing groups represented by the general formula (XVI) are described in U.S. Pat. No. 4,149,892 (incorporated herein by reference to disclose such groups).

Characteristics required for the reducing group R are as follows.

1. It is rapidly oxidized by the silver halide to effectively release a diffusible dye for image formation by the function of the dye releasing activator.

2. The reducing group R has an extensive hydrophobic property, because it is necessary for the dye releasing redox compound to be immobilized in a hydrophilic or hydrophobic binder and that only the released dye has diffusibility.

3. It has excellent stability to heat and to the dye releasing activator and does not release the image forming dye until it is oxidized; and 4. It is easily synthesized.

In the following, specific examples of preferred reducing groups R which satisfy the above described requirements are shown. In the example, NH-represents the bond to the dye portion.

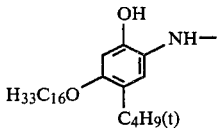

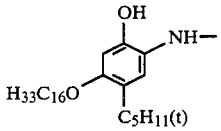

-continued
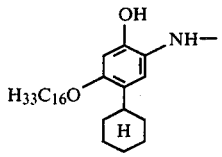
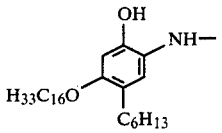
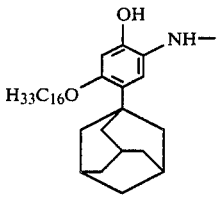
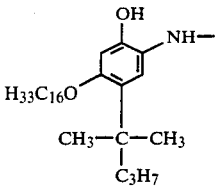
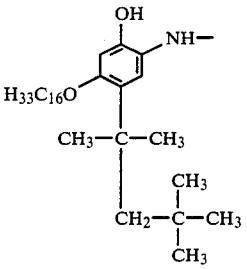
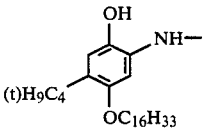
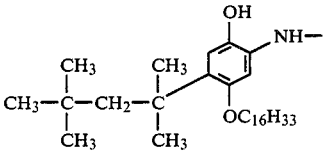
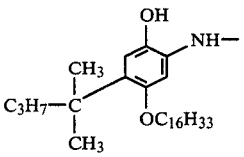
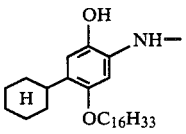
-continued
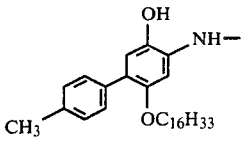
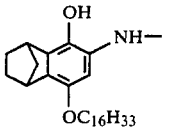
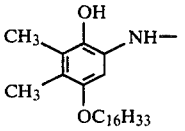
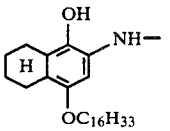
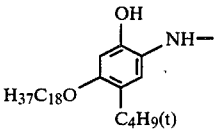
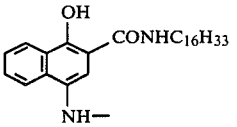
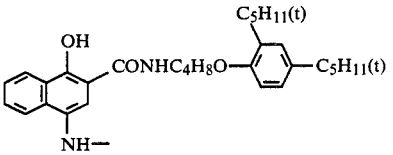
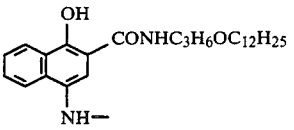
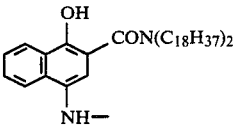
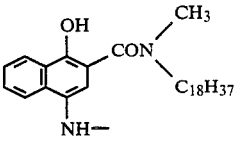
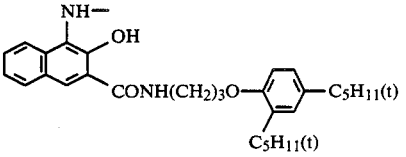

-continued

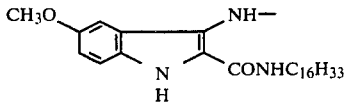

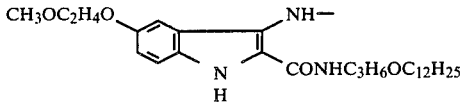

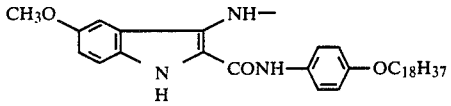

Examples of dyes which can be used for image forming dye portions D include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wave length region which is capable of regeneration during the development processing.

Yellow

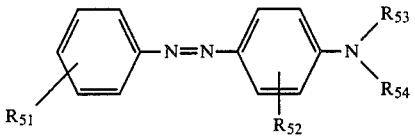

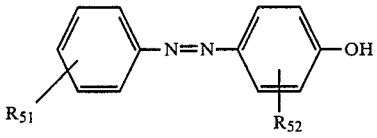

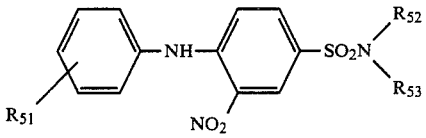

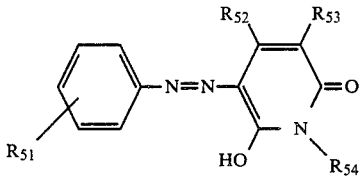

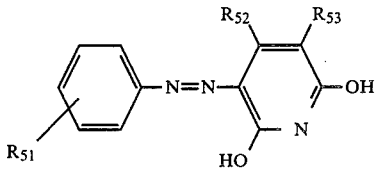

-continued

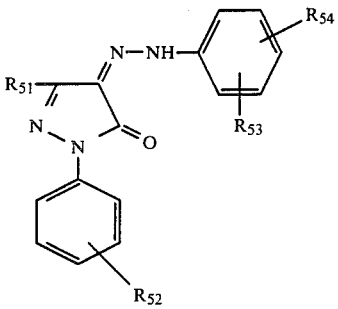

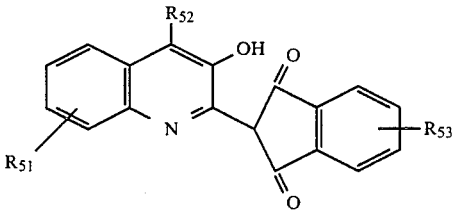

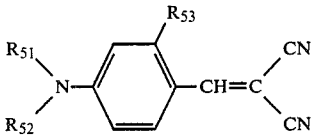

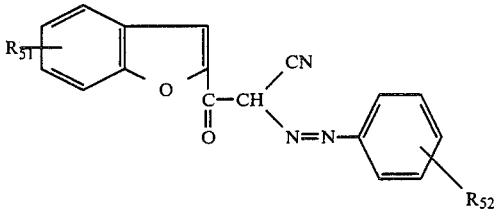

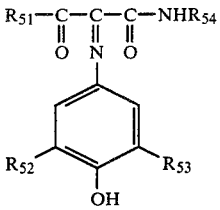

Magenta

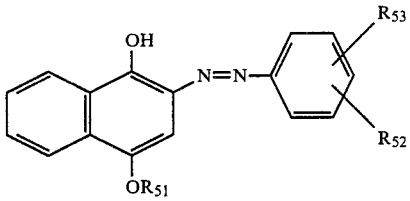

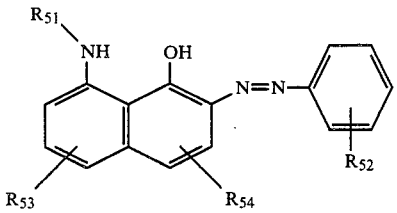

-continued
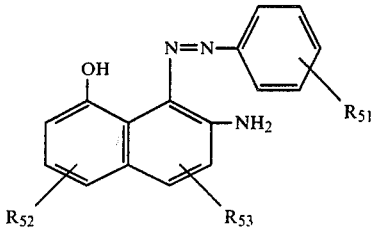
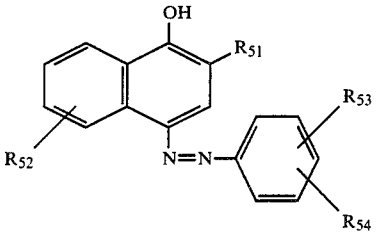
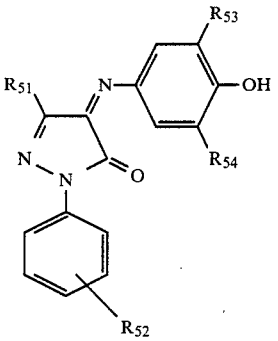
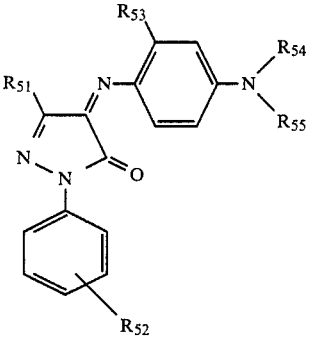
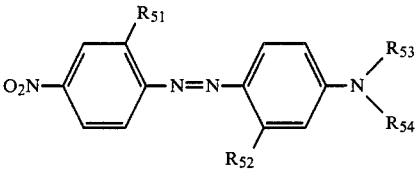
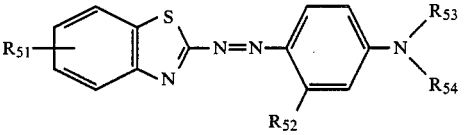
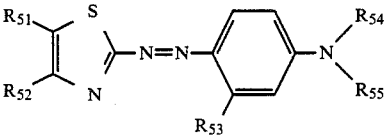
-continued
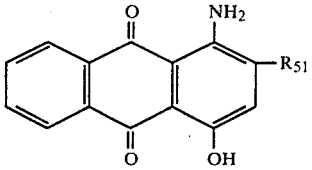
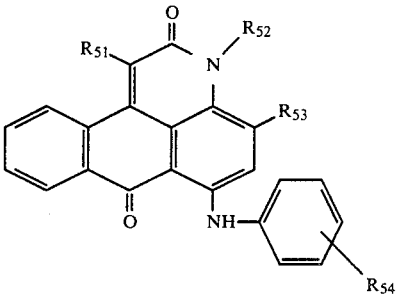
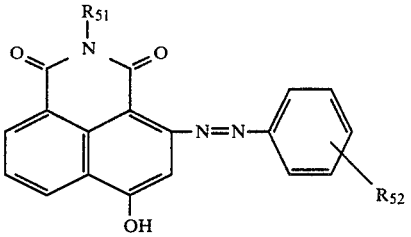
Cyan
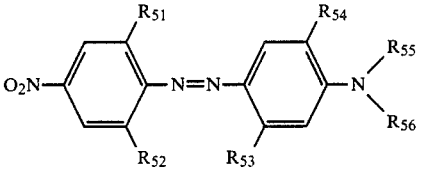
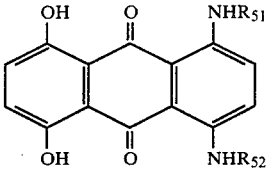
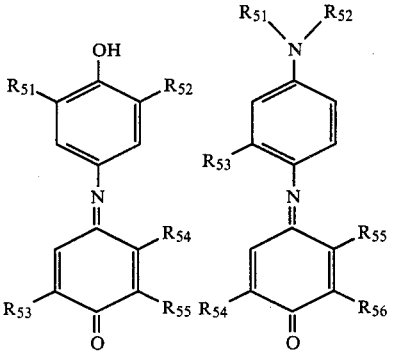
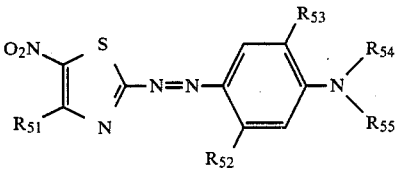

-continued

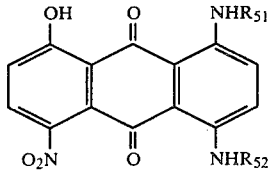

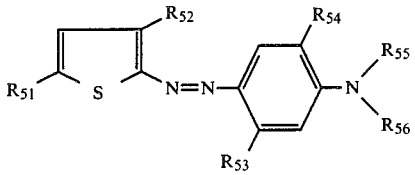

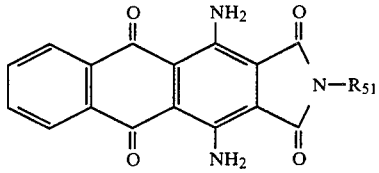

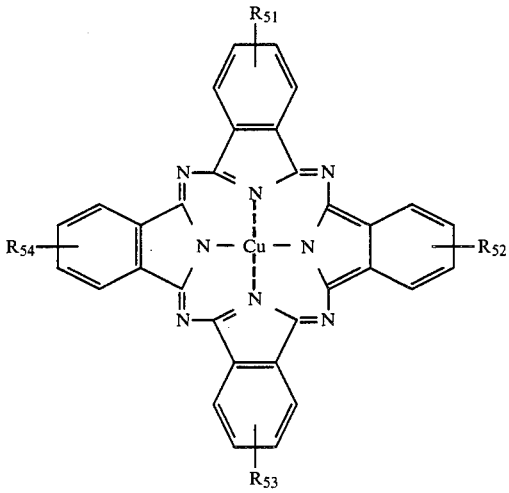

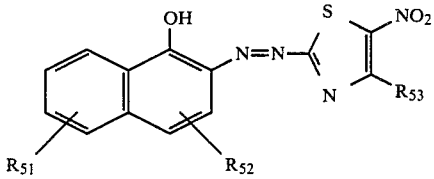

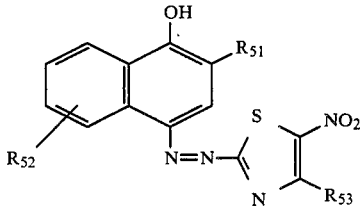

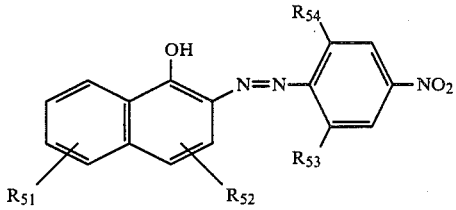

-continued

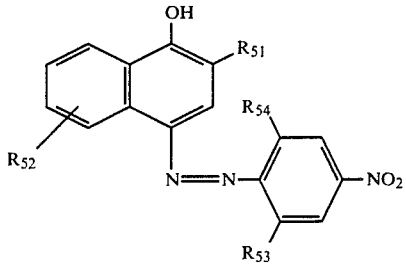

wherein $R_{51}$ and $R_{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonyl alkyl group, an alkoxyalkyl group, an aryloxyalkyl group, a nitro group, a halogen atom, a sulfamoyl group, an N-substituted sulfamoyl group, a carbamoyl ring, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, asulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition ($pKa<12$) are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Specific examples of preferred image forming dyes which satisfy the above described requirements are described in the following.

Yellow

-continued
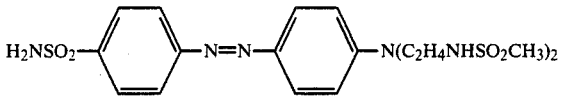
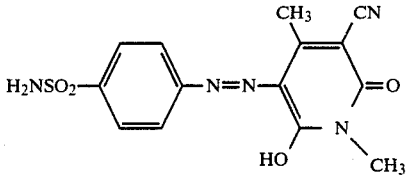
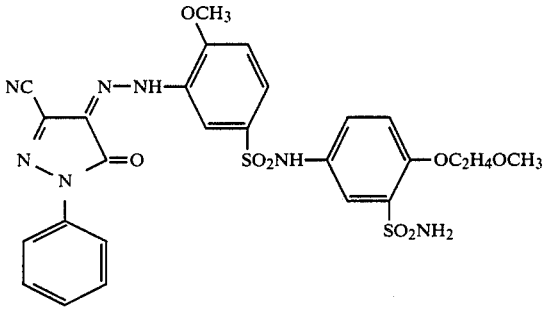
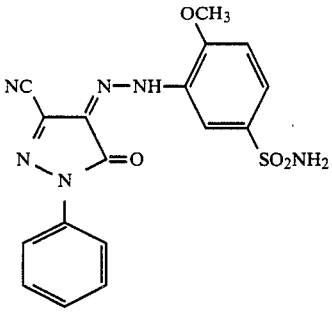
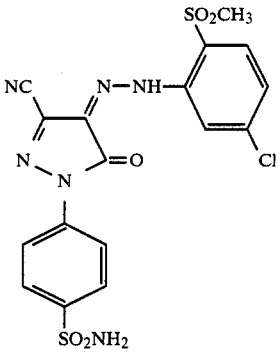
-continued
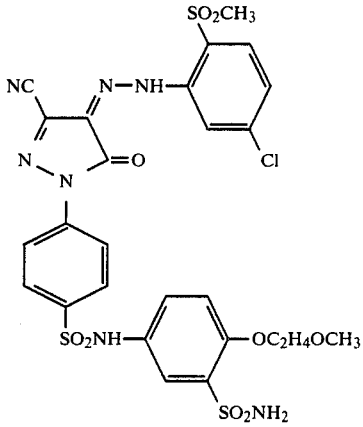
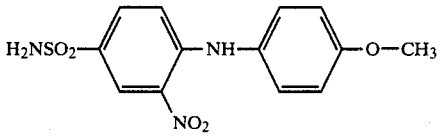
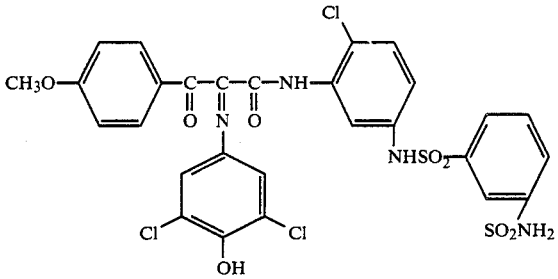
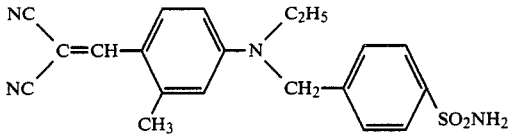
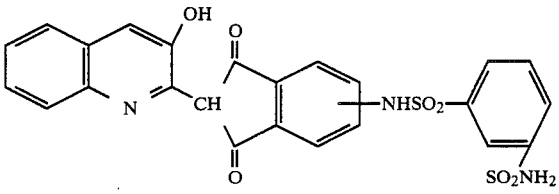
Magenta
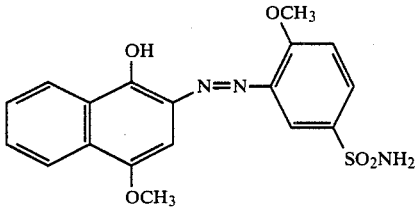

-continued
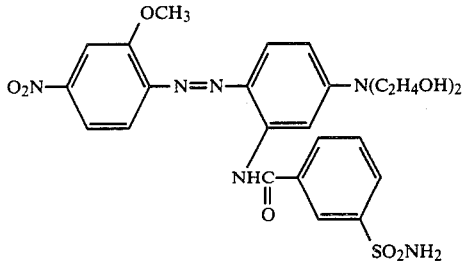
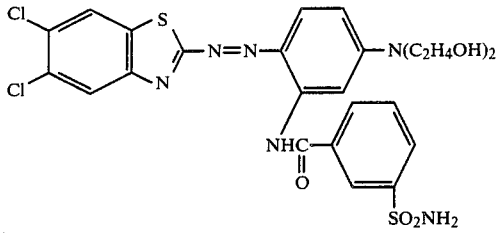
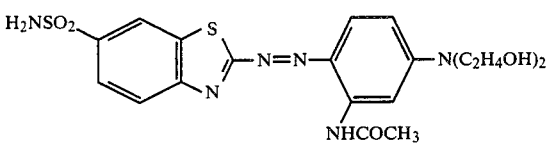
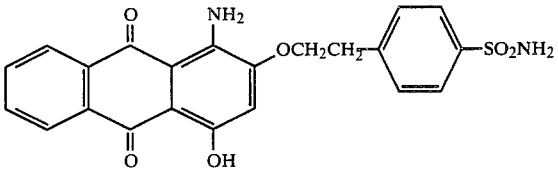
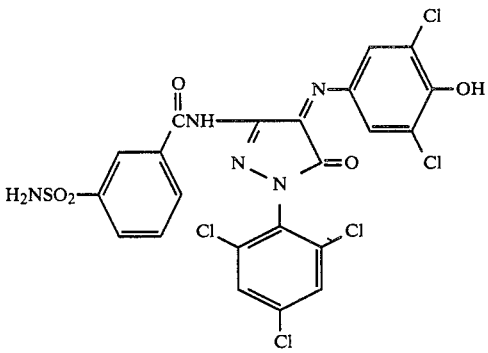
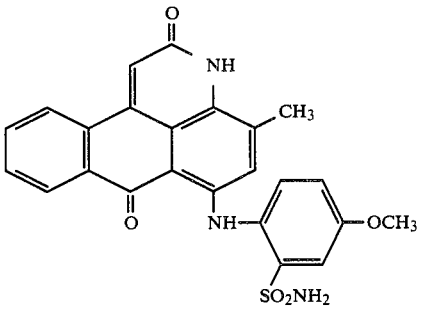
-continued
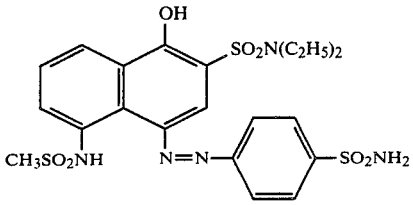
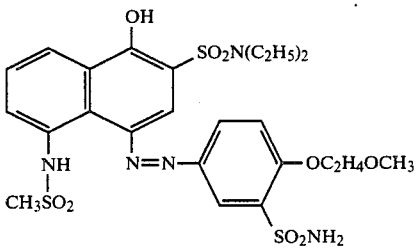
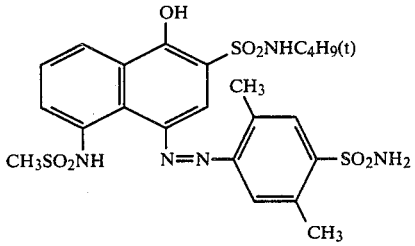
Cyan
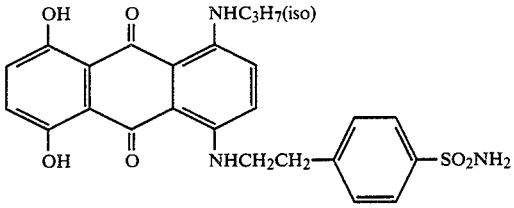
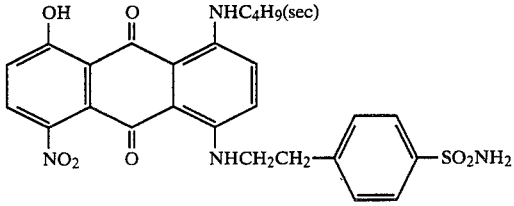
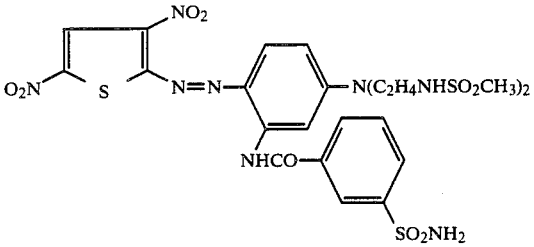

-continued
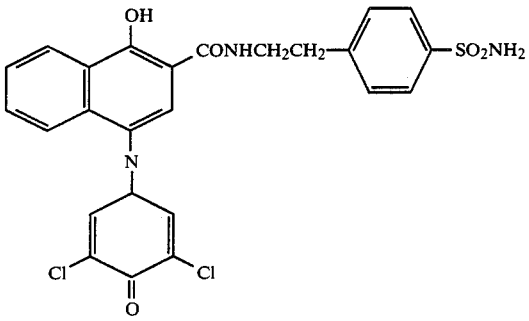
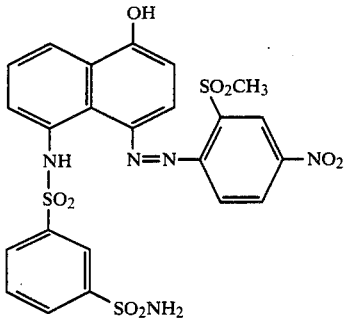
-continued
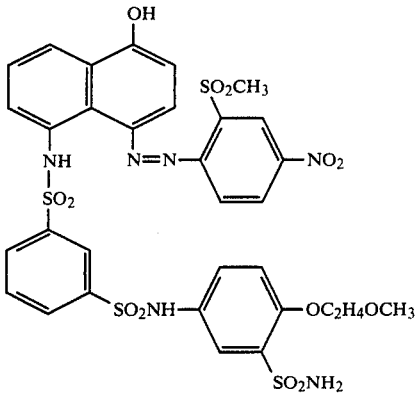
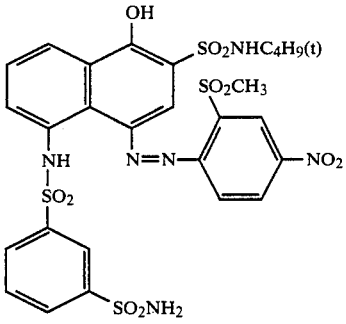
wherein the end group —$SO_2NH_2$ in these dyes represents a group necessary to bond to the reducing group R.
In the following, specific examples of the preferred dye releasing redox compounds are described.
A-(1)
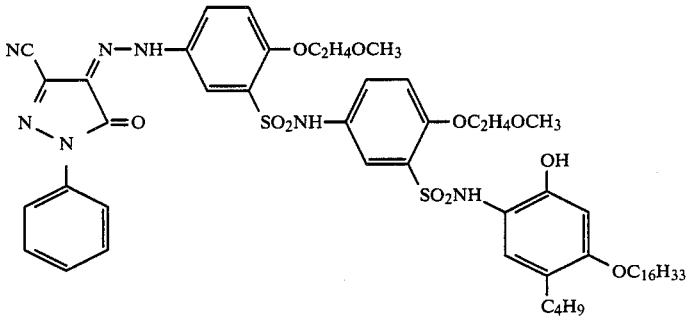

-continued
A-(2)
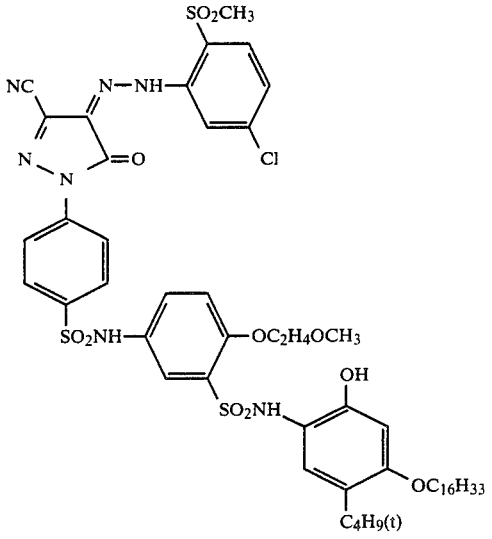
A-(3)
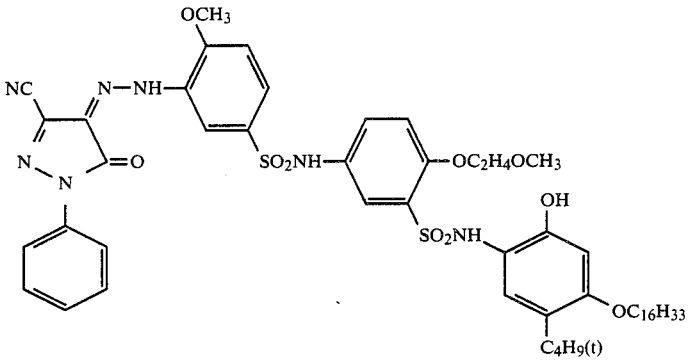
A-(4)
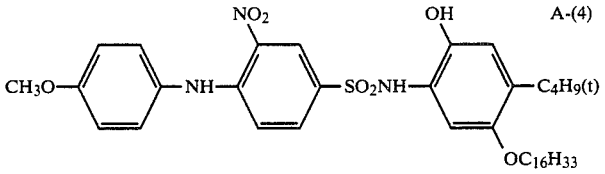
A-(5)
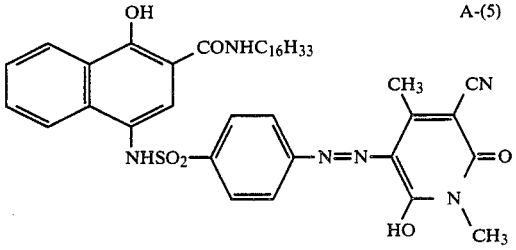
A-(6)
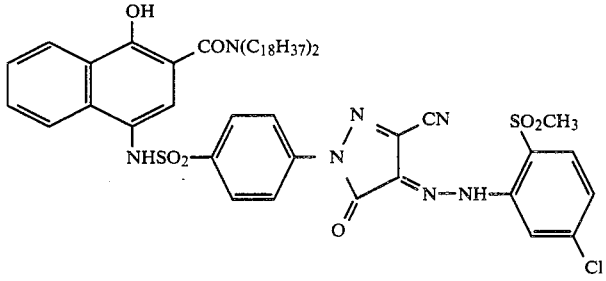

-continued
A-(7)
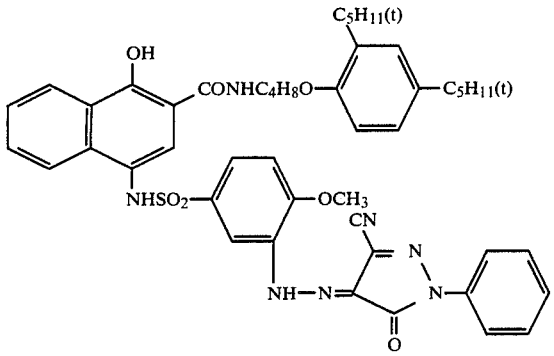
A-(8)
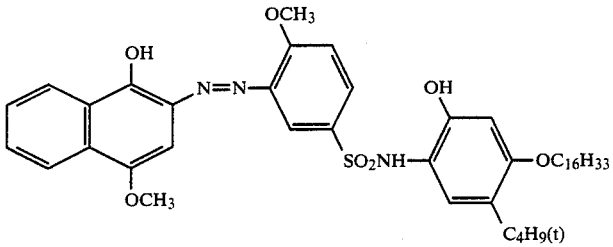
A-(9)
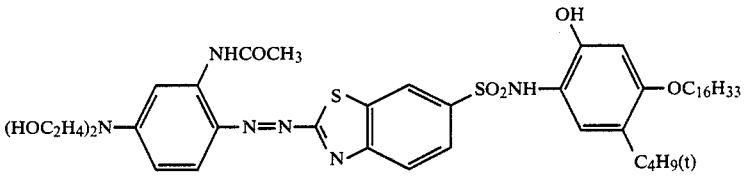
A-(10)
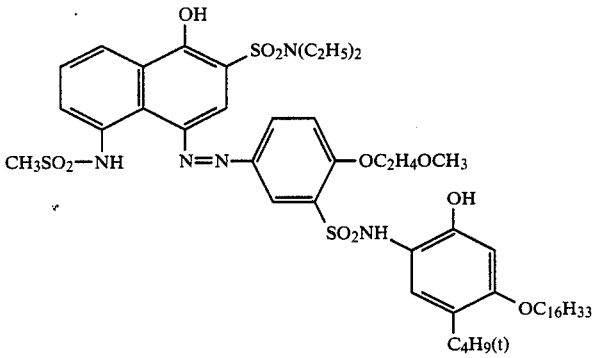
A-(11)
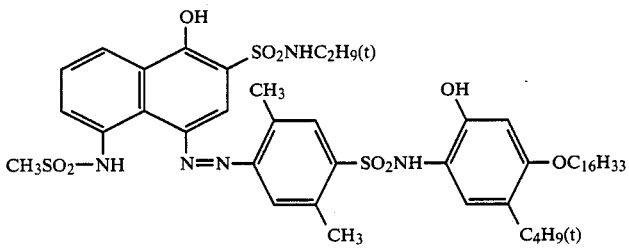

-continued
A-(12)
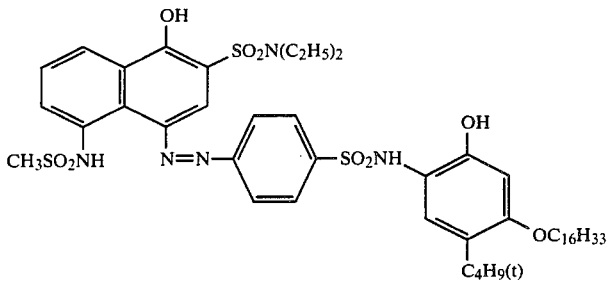
A-(13)
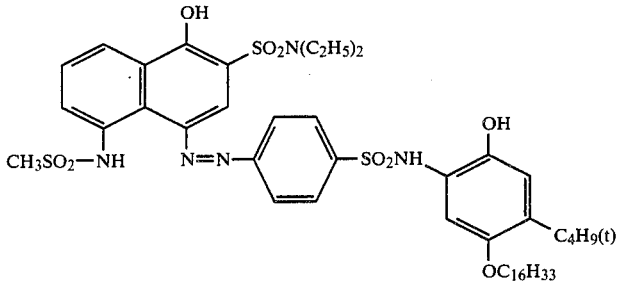
A-(14)
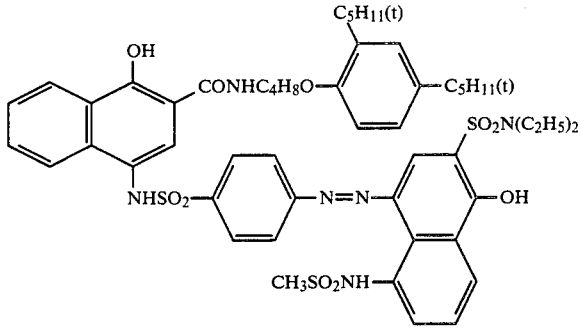
A-(15)
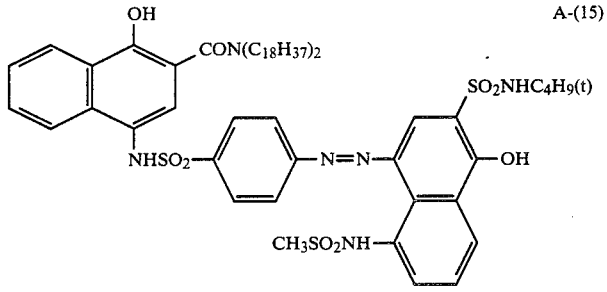
A-(16)
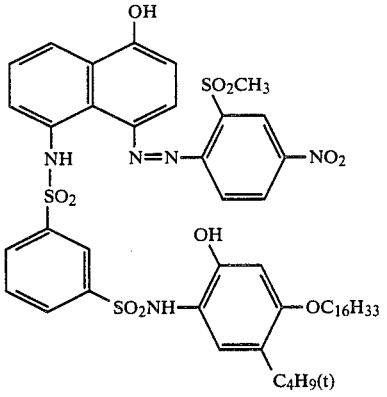

-continued
A-(17)
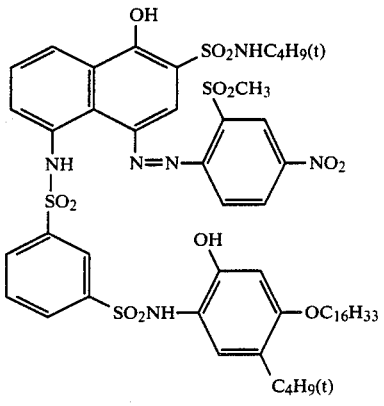
A-(18)
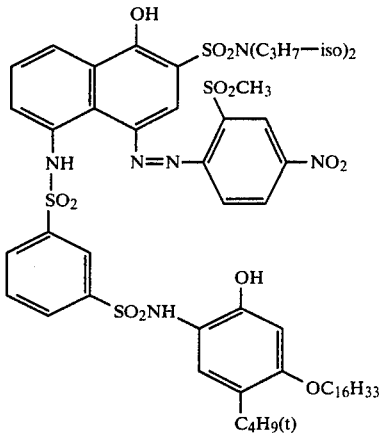
A-(19)
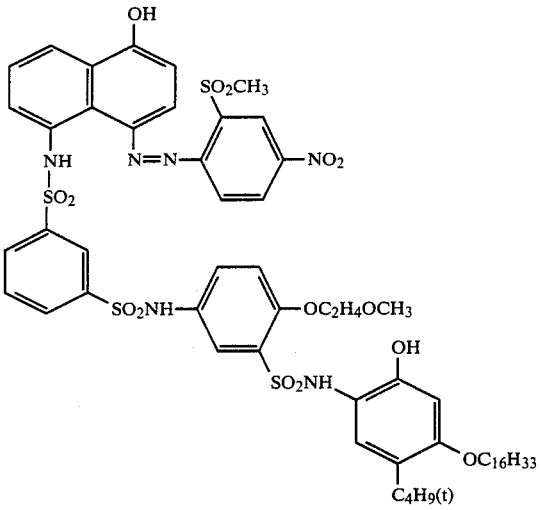
A-(20)
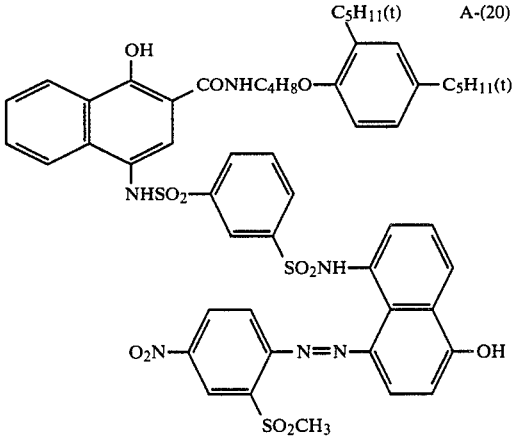
A-(21)
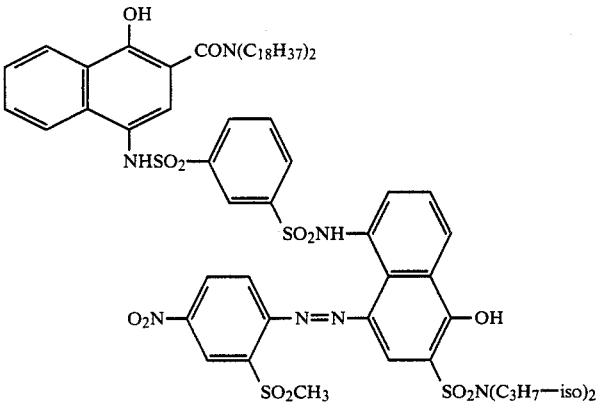
A-(22)
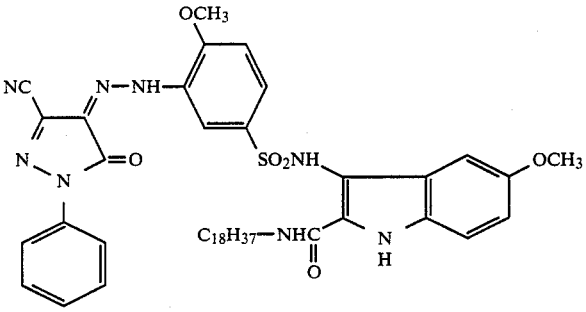

-continued
A-(23)
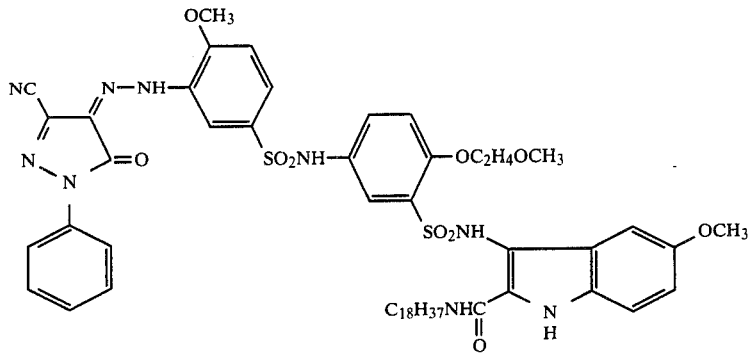
A-(24)
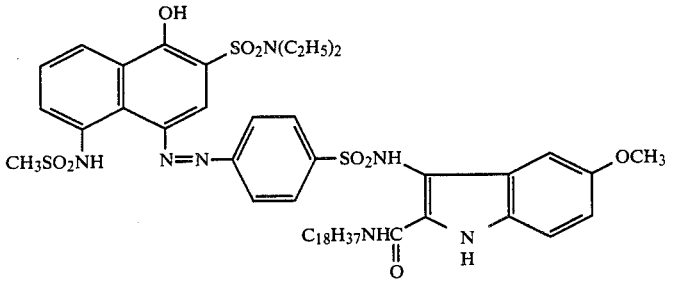
A-(25)
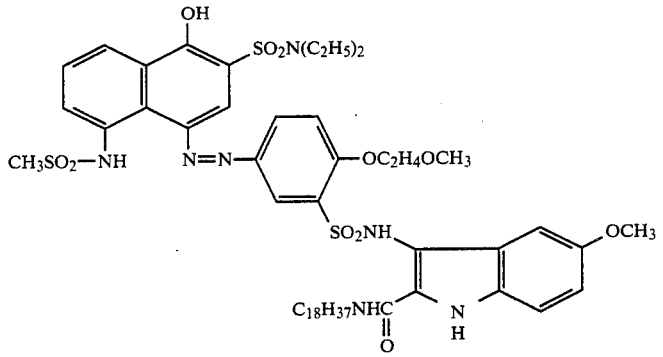
A-(26)
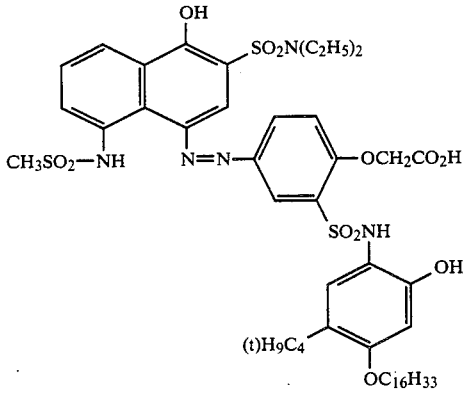
A-(27)
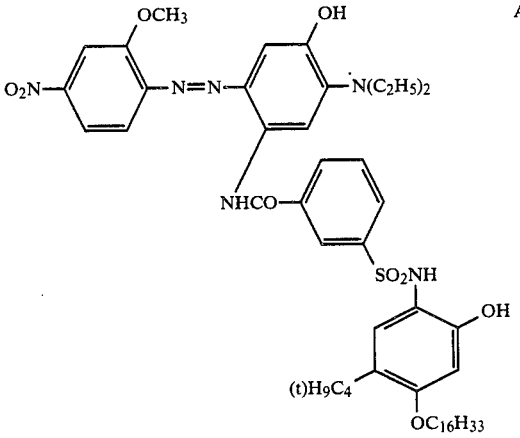

-continued
A-(28)
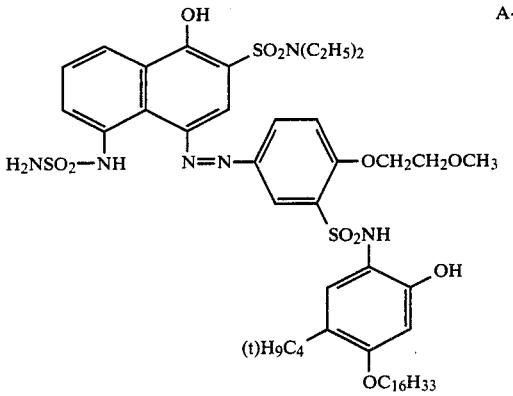
A-(29)
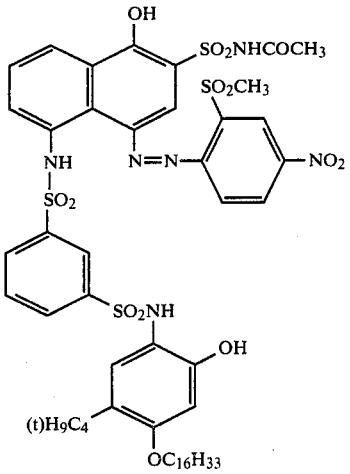
A-(30)
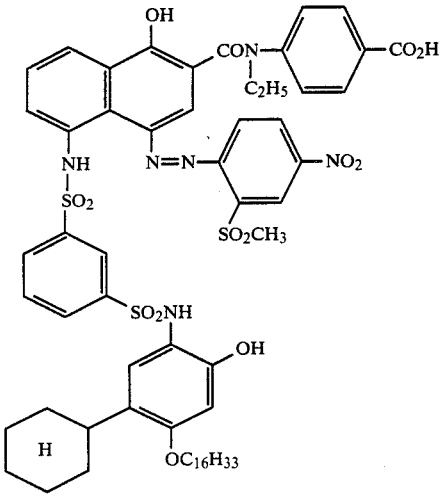
A-(31)
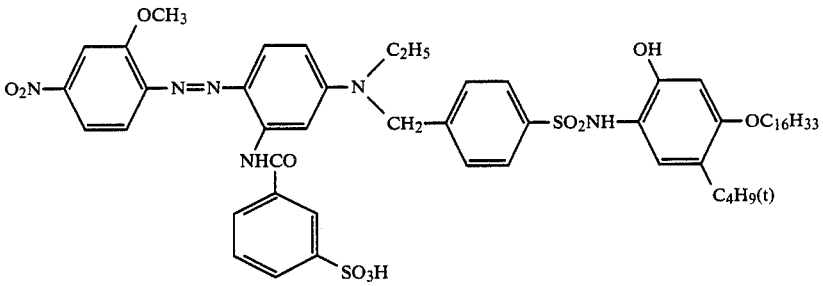
A-(32)
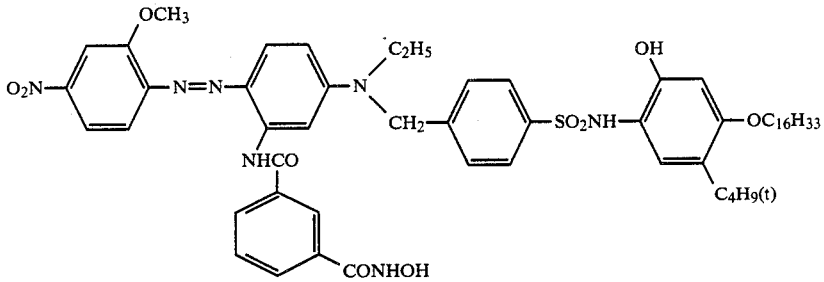

-continued
A-(33)
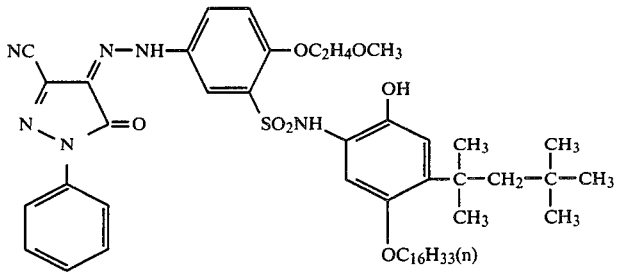
A-(34)
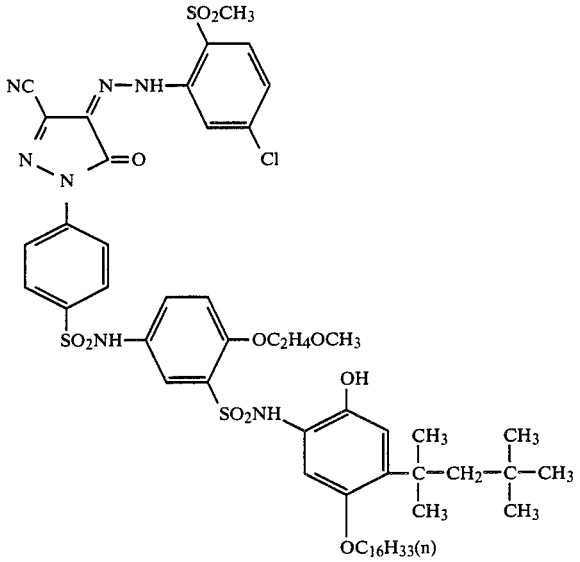
A-(35)
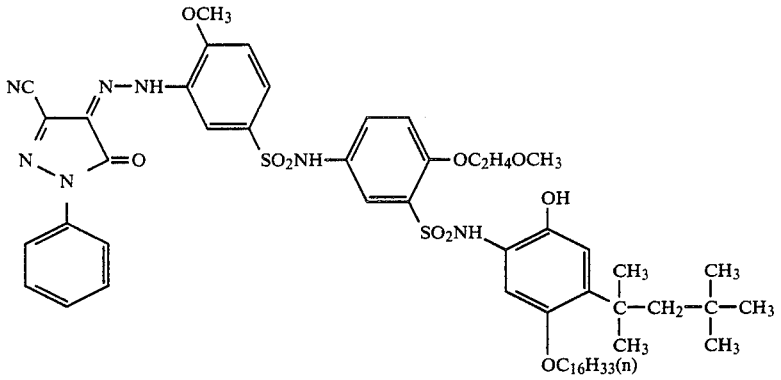
A-(36)
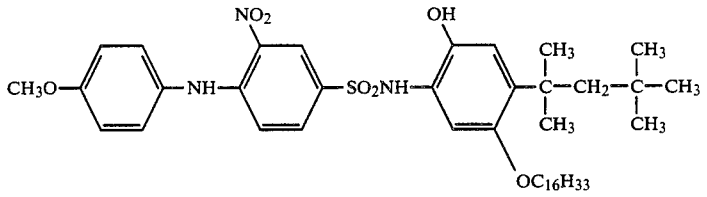
A-(37)
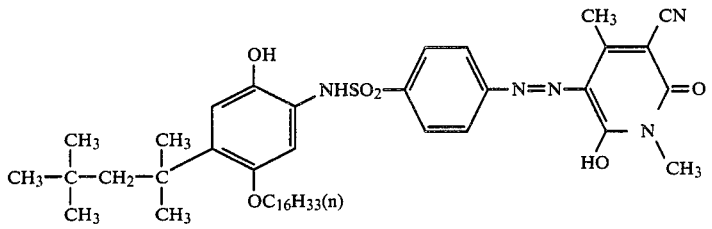

-continued
A-(38)
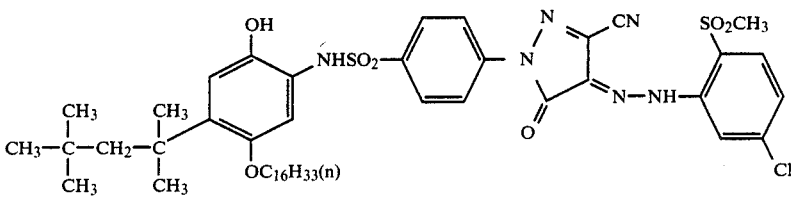
A-(39)
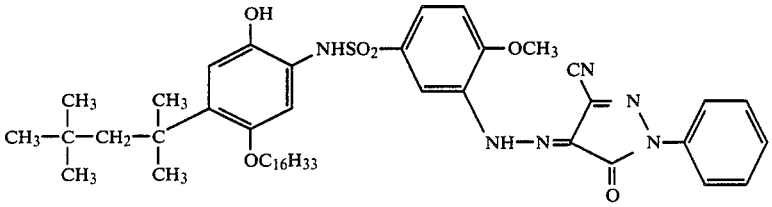
A-(40)
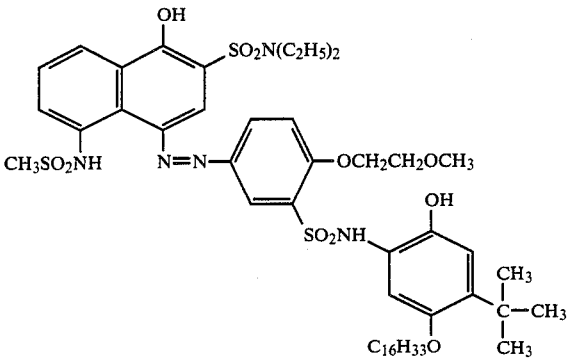
A-(41)
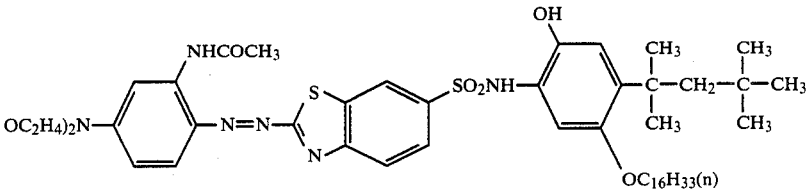
A-(42)
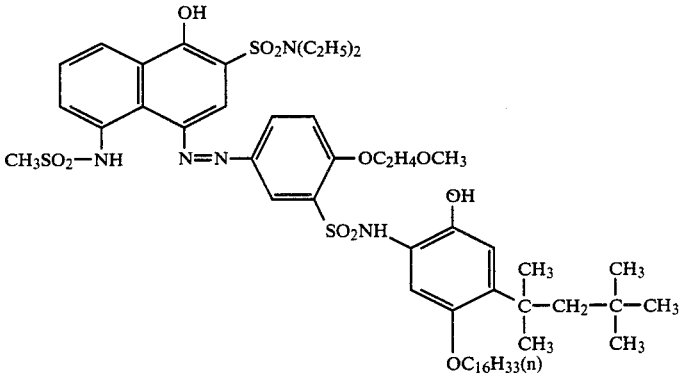
A-(43)
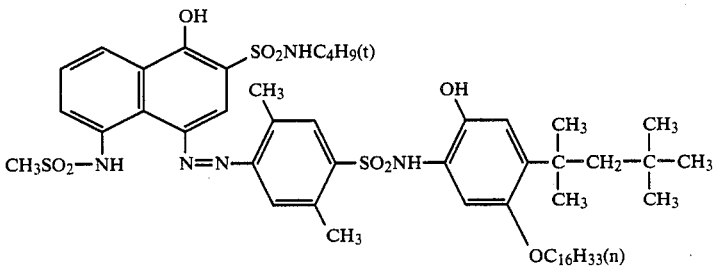

-continued
A-(44)
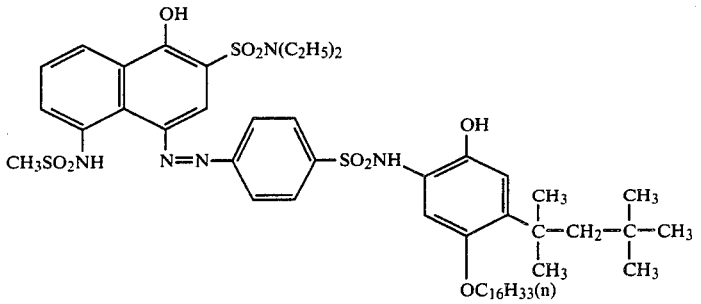
A-(45)
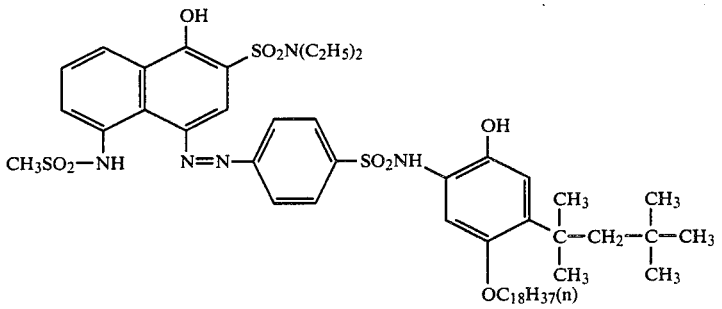
A-(46)
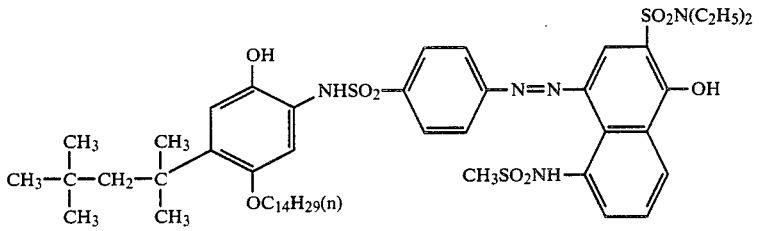
A-(47)
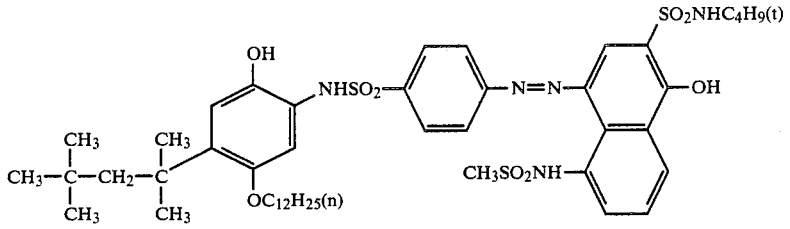
A-(48)
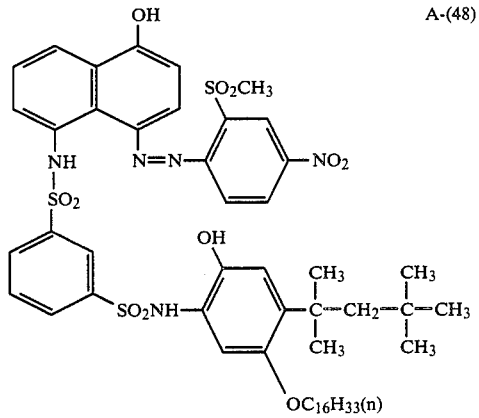
A-(49)
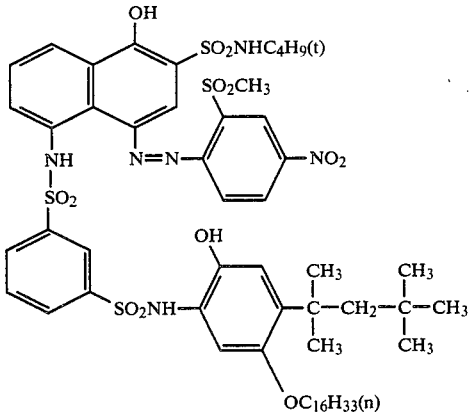

-continued
A-(50)
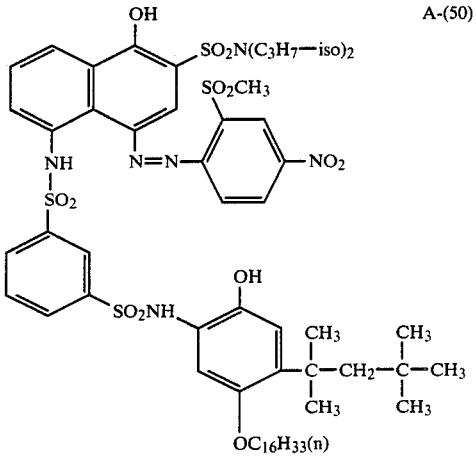
A-(51)
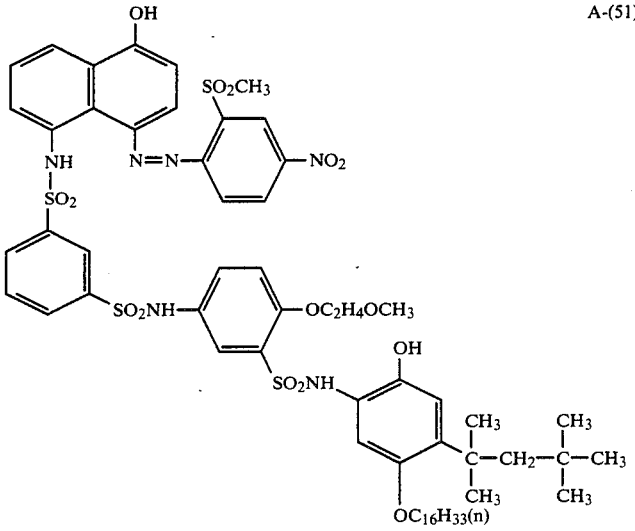
A-(52)
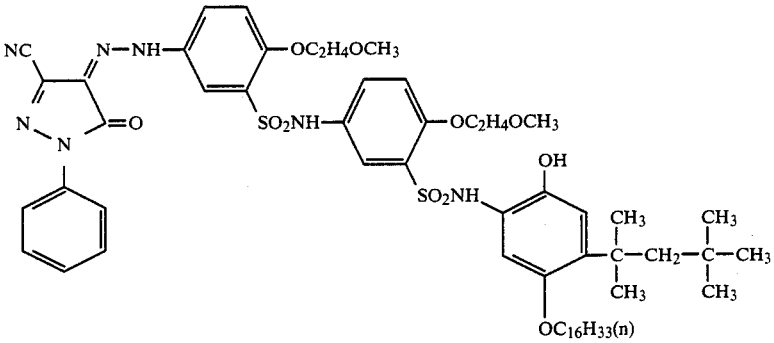
A-(53)
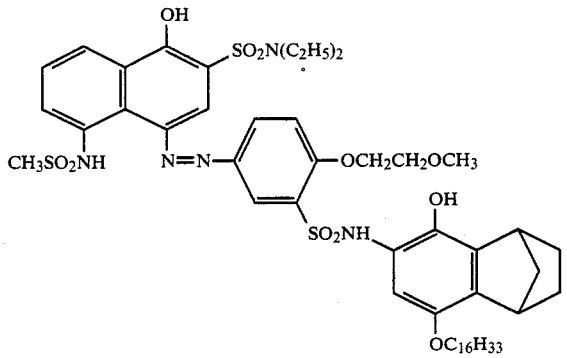
A-(54)
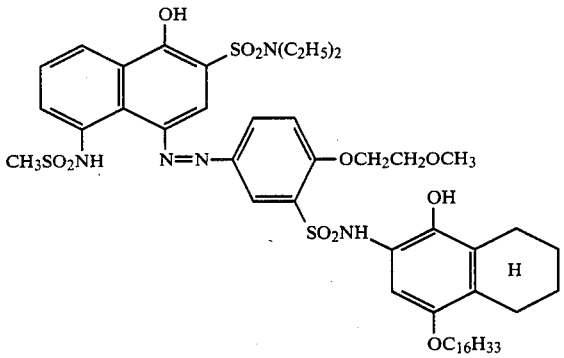

-continued
A-(55)
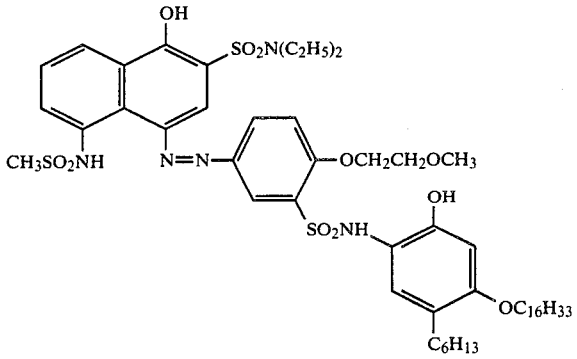
A-(56)
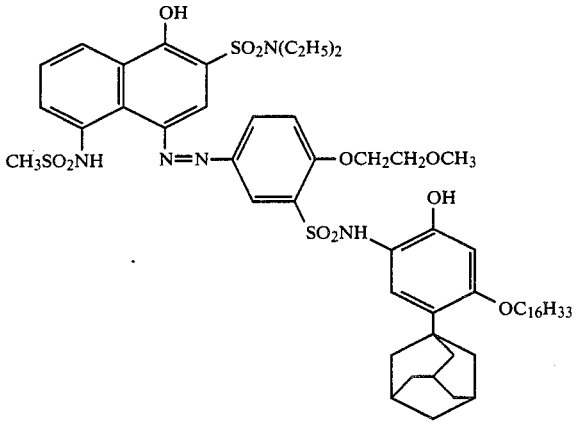
A-(57)
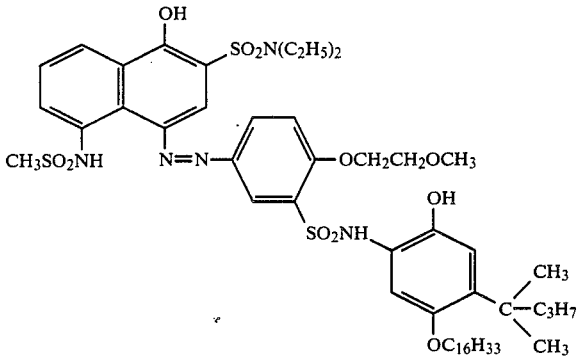
A-(58)
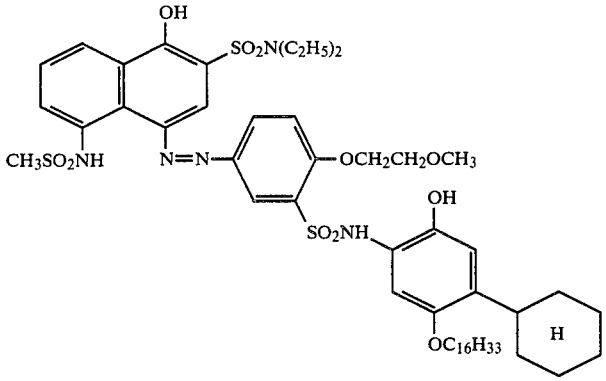

-continued
A-(59)
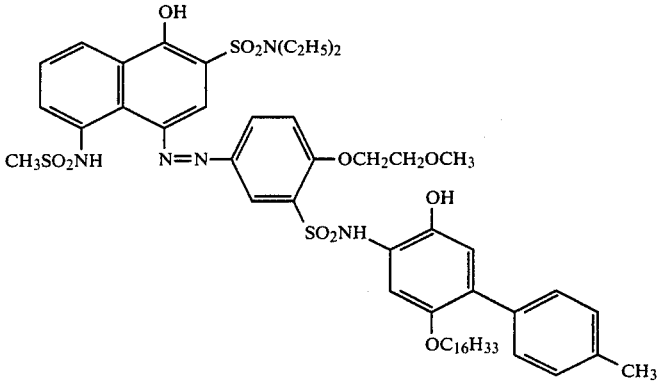
A-(60)
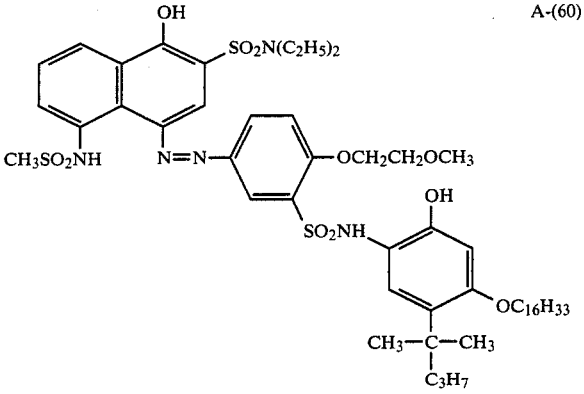
A-(61)
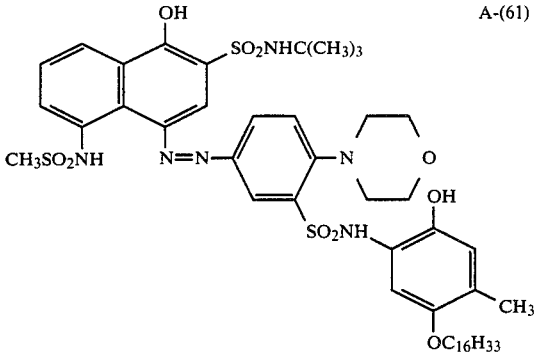
A-(62)
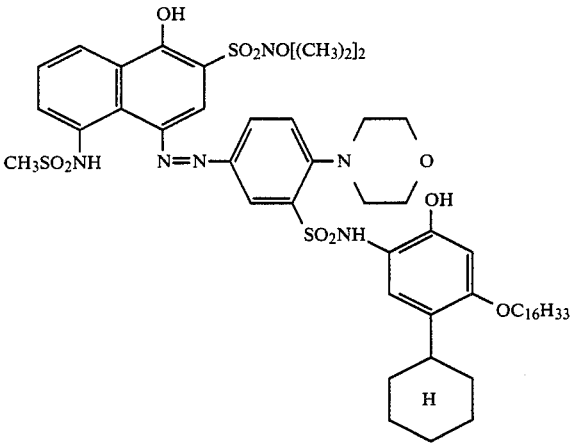
A-(63)
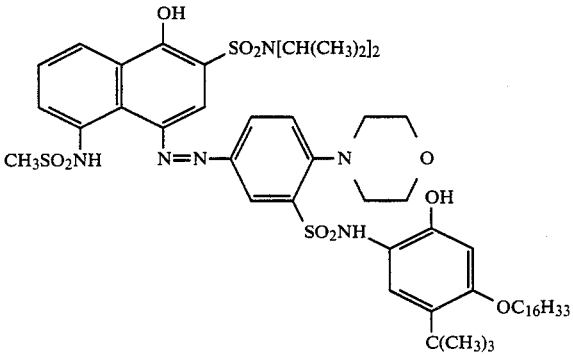

-continued

A-(64)

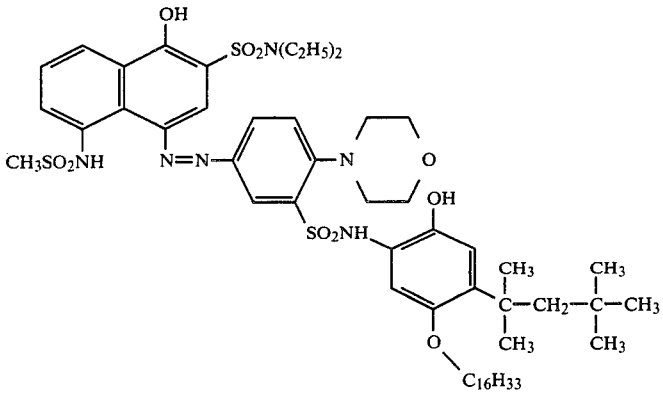

A-(65)

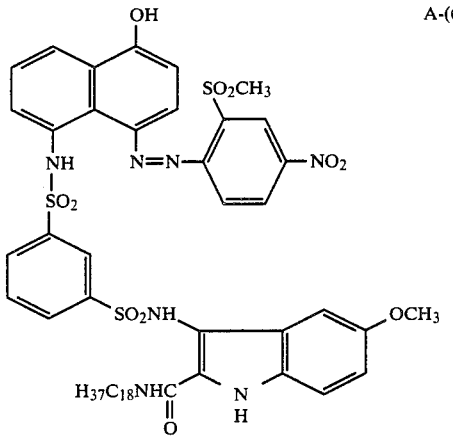

A-(66)

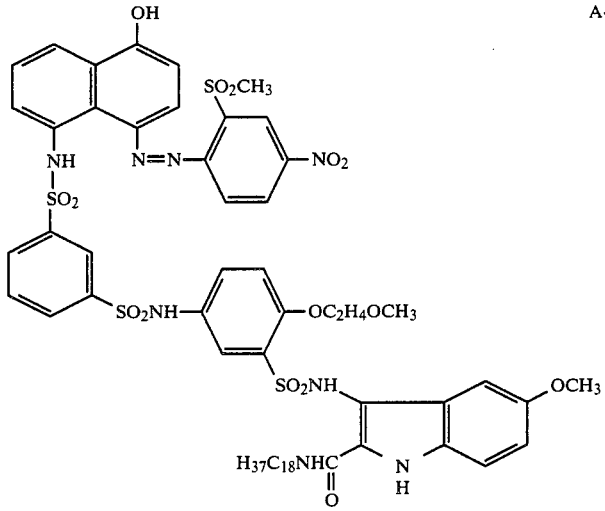

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application B Ser. No. 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above described specific examples.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

The mercaptan compounds used in the present invention can be synthesized in the following methods: (1) A corresponding aniline derivative was reacted with sodium nitrite under an acid condition to form a diazonium salt and then the latter is reacted with sodium sulfide whereby a thiophenol derivative is obtained as illustrated in reaction Scheme I below.

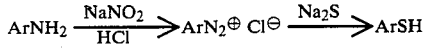

Reaction Scheme I (2) A benzene derivative introduced a substituent according to the purpose of the present invention is chlorosulfonated with chlorosulfonic acid and then reduced using metalic zinc or metalic tin and an acid whereby a thiophenol derivative is obtained as illustrated in Reaction Scheme II below.

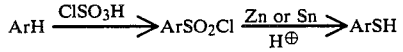

Reaction Scheme II

When a sulfonic acid derivative is available as a starting material, it is converted to a sulfonyl chloride derivative using thionyl chloride, phosphorus oxychloride, etc. and then reduced in accordance with the above described Reaction Scheme II.

(3) A corresponding phenol derivative is converted to a sodium salt which is reacted with dimethylthiocarbamoyl chloride to prepare a dimethylthionecarbamate derivative. The latter is subjected to heat rearrangement to form a dimethylthiolcarbamate derivative which is then hydrolyzed whereby a thiophenol derivative is obtained as illustrated in Reaction Scheme III below. This method is described in *J. Org. Chem.*, Vol. 31, page 3980 (1956).

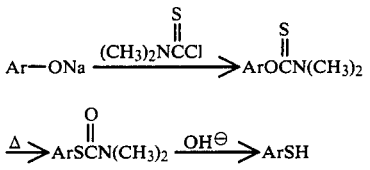

Reaction Scheme III (4) A corresponding alkyl halide is reacted with hydrogen sodium sulfide to obtain an alkylmercaptan as illustrated in Reaction Scheme IV below.

$$RX + NaSH \rightarrow RSH$$

Reaction Scheme IV (5) A corresponding halide derivative is reacted with thiourea to prepare an isothiurominum salt thereof and the latter is subjected to alkaline hydrolysis whereby a mercaptan compound is obtained as illustrated in Reaction Scheme V below.

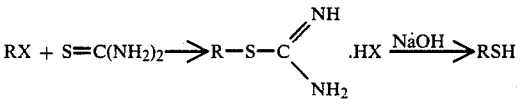

Reaction Scheme V

In the following, synthesis examples of the specific compounds used in the present invention are set forth. Other mercaptan compounds can be synthesized according to the general methods described above.

SYNTHESIS EXAMPLE 1

Synthesis of 3-phenoxypropanethiol [Compound (17)]

160 g of 3-bromopropyl phenyl ether and 63 g of thiourea were dissolved in 300 ml of ethanol and the solution was refluxed with heating for 3 hours. A methanol solution containing 194 g of potassium hydroxide was added to the reaction solution and the mixture was stirred at 50° C. for 2 hours. The mixture was poured into diluted hydrochloric acid and extracted with ethyl acetate followed by distillation under reduced pressure to obtain 76.5 g of 3-phenoxypropanethiol. A boiling point was 135° to 138° C. at 17 mm Hg.

SYNTHESIS EXAMPLE 2

Synthesis of 2-butoxy-5-(1,1,3,3-tetramethylbutyl)benzenethiol [Compound (43)]

41.2 g of 4-(1,1,3,3-tetramethylbutyl)phenol, 30.2 g of butyl bromide and 36 g of potassium carbonate were heated with stirring in 150 ml of acetone for 20 hours. The reaction solution was poured into water, extracted with ethyl acetate and the solvent was distilled off under reduced pressure. The residue was dissolved in 100 ml of methylene chloride and to the solution was added dropwise 16 ml of chlorosulfonic acid at a temperature below 10° C. The solvent was distilled off under reduced pressure, to the residue were added 60 ml of dimethyl acetamide and 20 ml of acetonitrile and then 37 ml of phosphorus oxychloride was added dropwise at a temperature below 40° C. After stirring for 1 hour at room temperature, 120 g of ice and 30 ml of sulfuric acid were added, then 48 g of zinc was added and the mixture was stirred for 2 hours at 85° to 90° C. After cooling, the residual zinc was removed by filtration and extracted with hexane. The hexane was distilled off under reduced pressure and the residue was separated using a silica gel column (solvent: hexane) to obtain 48 g of the oily desired compound.

The dye releasing redox compound which releases a diffusible dye according to the present invention can be used in an amount of a fixed range. Generally, a suitable range is about 0.01 mol to about 4 mols of the dye releasing redox compound per mol of the silver halide. A particularly suitable amount in the present invention is in a range of about 0.03 to about 1 mol per mol of the silver halide.

In the present invention, if necessary, a reducing agent for reducing a silver halide and/or an organic silver salt oxidizing agent may be used. The reducing agent in this case is the so-called auxiliary developing agent, which is oxidized by the silver halide and/or the organic silver salt oxidizing agent to form its oxidized product having an ability to oxidize the reducing group R in the dye releasing redox compound.

Examples of useful auxiliary developing agents include hydroquinone, alkyl substituted hydroquinones such as tertiary butylhydroquinone, 2,5-dimethylhydroquinone, methylhydroquinone, tertiary octylhydroquinone normal octylhydroquinone, 2-methyl-5-tertiary octylhydroquinone, 2,5-di-tertiary amylhydroquinone, 2,5-di-tertiary hexylhydroquinone, 2,5-di-tertiary octylhydroquinone, 2,5-di-normal octylhydroquinone, 2,5-didodecyl hydroquinone sodium 5-pentadecahydroquinone-2-sulfonate, trimethylhydroquinone, tolylhydroquinone, etc., catechols, pyrogallols, halogen substituted hydroquinones such as chlorohydroquinone, dichlorohydroquinone, etc. alkoxy substituted hydroquinones such as methoxyhydroquinone, and polyhydroxybenzene derivatives such as methyl hydroxynaphthalene, etc. Further, there are methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone or 4-methyl-4-hydroxymethyl-1-phenyl-3-pyrazolidone, etc., reductones and hydroxy tetronic acids.

The auxiliary developing agent can be used in an amount of a fixed range. A suitable range is 0.01 time by mol to 20 times by mol based on the silver halide. A particularly suitable range is 0.1 time by mol to 4 times by mol.

The auxiliary developing agent can be added to a coating solution as a solution thereof in water or a water miscible solvent or together with the dye releasing redox compound in case of preparation of dye releasing redox compound dispersion.

Examples of silver halides used include silver chloride, silver chlorobromide, silver chloroiodide, silver bromide, silver iodobromide, silver chloroiodobromide and silver iodide, etc.

Particularly preferred examples of silver halide used in the present invention partially contain a silver iodide crystal in its particle. That is, the silver halides the X-ray diffraction pattern of which show that of pure silver iodide are particularly preferred.

In photographic materials a silver halide containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and showing X-ray diffraction pattern of silver iodide.

The process for preparing those silver halides is explained taking the case of silver iodobromide. That is, the silver iodobromide is prepared by adding silver nitride solution to potassium bromide solution to form silver bromide and further adding potassium iodide to the mixing solution.

The silver halide has a particle size of from 0.001 μm to 2 μm and, preferably, from 0.001 μm to 1 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pp. 149–169.

In the particularly preferred embodiment of the present invention, an organic silver salt oxidizing agent is used togehter.

The organic silver salt oxidizing agent which can be used in the present invention is a silver salt which is comparatively stable to light and which forms a silver image by reacting with the above described dye releasing redox compound or a reducing agent coexisting, if necessary, with the dye releasing redox compound, when it is heated to a temperature of above 80° C. and, preferably, above 100° C. in the presence of exposed silver halide. By coexisting the organic silver salt oxidizing agent, the photographic material which provides higher color density can be obtained. An amount of the organic silver salt oxidizing agent used in the present invention is in the range of from 0 to 100 mols and preferably from 0.2 to 10 mols per mol of the silver halide.

Examples of such organic silver salt oxidizing agents include silver salts of carboxylic acid derivatives and N-containing heterocyclic ring compounds. Preferred examples of such organic silver salt oxidizing agents include silver salts of N-containing heterocyclic ring compounds.

Specific examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione, etc. as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., can be used as well as the organic silver salt oxidizing agent capable of being used in the present invention.

The mechanism of the heat-development process under heating in the present invention is not entirely clear, but it is believed to be as follows.

When the photographic material is exposed to light, a latent image is formed in a light-sensitive silver halide. This phenomenon is described in T. H. James, *The Theory of the Photographic Process,* Third Edition, pages 105–148.

When the photographic material is heated, the reducing agent, the dye releasing redox compound, in the case of the present invention reduces the silver halide or the silver halide and the organic silver salt oxidizing agent with the assistance of an alkaline agent released by heating in the presence of the latent image nuclei as a catalyst to form silver or a metal, while it is oxidized itself. The oxidized product of the dye releasing redox compound is attacked by a nucleophilic reagent (a dye releasing activator in the case of the present invention) to release a dye.

When the organic silver salt oxidizing agent is used together, the silver halide and the organic silver salt oxidizing agent which form a starting point of a development should be present within a substantially effective distance.

For this purpose, it is desired that the silver halide and the organic silver salt oxidizing agent are present in the same layer or layers adjacent to each other.

The silver halide and the organic metal salt oxidizing agent which are separately formed can be mixed prior to use to prepare a coating solution, but it is also effective to blend both of them in a ball mill for a long period of time. Further, it is affective to use a process which comprises adding a halogen containing compound to the organic silver salt oxidizing agent prepared to form silver halide using silver of the organic silver salt oxidizing agent.

Methods of preparing these silver halide and organic salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg to 10 g/m$^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination of two or more. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material. Preferred examples of hydrophilic binder include gelatin and a gelatin derivative.

In the heat-developable color photographic material of the present invention, various kinds of dye releasing activator may be used. The dye releasing activator means a substance which attacks nucleophilically the oxidized dye releasing redox compound to release a diffusible dye, and a base, a base releasing agent and a water releasing compound are used. In these dye releasing activators, the bases and the base releasing agents are particularly preferred because they not only accelerate release of the dye but also accelerate the oxidation-reduction reaction between the silver halide or the organic silver salt oxidizing agent and the dye releasing redox compound.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base releasing agent is a substance which releases a basic component by heating. Examples of typical base releasing agents have been described in British Patent No. 998,949. A preferred base releasing agent is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetic acid described in U.S. Pat. No. 3,220,846 is particularly preferred. Further, aldonic amides described in Japanese Patent Application (OPI) No. 22625/75 are suitably used because they decompose at a high temperature to form a base.

The water releasing compound means a compound which releases water by decomposition during heat development to convert into a compound having a vapor pressure of $10^{-5}$ Torrs or more at a temperature of 100° to 200° C. These compounds are known in the field of printing of fabrics, and $NH_4Fe(SO_4)_2.12H_2O$, etc., as described in Japanese Patent Application (OPI) No. 88386/75 are useful.

These dye releasing activators can be used in an amount of a broad range. It is preferably used in an amount in the range of 1/100 to 10 times and, particularly, 1/20 to 2 times by molar ratio based on silver.

Further, in the heat-developable color photographic light-sensitive materials of the present invention, it is possible to use compounds which activate development simultaneously while stabilizing the images. Particularly, it is suitable to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium.trifluoroacetate), etc., as described in U.S. Pat. No. 3,669,670, thiol compounds as described in German Patent Application (OLS) No. 2,162,714, thiazolium compounds such as 2-amino-2-thiazolium.trichloroacetate, 2-amino-5-bromoethyl-2-thiazolium.trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

These compounds or mixtures thereof can be used in a wide range of amounts. It is preferable to use them in a range of 1/100 to 10 times and, particularly, 1/20 to 2 times by molar ratio based on silver.

In the heat-developable color photographic material of the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have —$SO_2$— or —CO— such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 (Dec., 1976), etc.

In the heat-developable color photographic material of the present invention, a polyethylene glycol type nonionic surface active agent having a recurring unit of ethylene oxide in its molecule may be incorporated. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used independently or as a mixture of two or more of them.

Preferred examples of nonionic surface active agents include polyethylene glycol type nonionic surface active agents.

The polyethylene glycol type nonionic surface active agents can be used in an amount of less than 100% by weight, preferably less than 50% by weight, based on a hydrophilic binder.

The photographic material of the present invention may contain a cationic compound containing a pyridinium group. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the present invention, though it is not necessary to incorporate substances or dyes for preventing irradiation or halation in the photographic material, becauase the photographic material is colored by the dye releasing redox compound, it is possible to add filter dyes or light absorbing materials, etc., as described in Japanese Patent Publication No. 3692/73 and U.S. Pat. Nos. 3,253,921, 2,527,583 and 2,956,879 in order to further improve sharpness. It is preferred that these dyes have a thermal bleaching property. For example, dyes as described in U.S. Pat. Nos. 3,769,019, 3,745,009 and 3,615,432 are preferred.

The photographic material according to the present invention may contain, if necessary, various additives known for the heat-developable photographic materials and may have a layer other than the light-sensitive layer, for example, an antistatic layer, an electrically conductive layer, a protective layer, an intermediate layer, an antihalation layer, a strippable layer, a resistant heating layer as described in Japanese Patent Application (OPI) No. 66442/73, etc. Examples of additives include those described in *Research Disclosure,* Vol. 170, No. 17029 (June, 1978), for example, plasticizers, dyes for improving sharpness, antihalation dyes, sensitizing dyes, matting agents, surface active agents, fluorescent whitening agents and fading preventing agent, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 3,681,294 and drying in the same manner as used in preparing the heat-developable photographic layer of the present invention, by which the photographic material is obtained.

If necessary, two or more layers may be applied at the same time by the method as described in U.S. Pat. No. 2,761,791 and British Patent No. 837,095.

Various means of exposure can be used in connection with the heat-developable photographic material of the present invention. Latent images are obtained by image-wise exposure by radiant rays including visible rays. Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and forcusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to release a yellow dye, a magenta dye and a cyan dye, respectively.

The photographic material is produced using a construction such that the green-sensitive part (layer) contains a yellow dye releasing redox compound, the red-sensitive part (layer) contains a magneta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing, the so-called image treatment, and resulting image information is reproduced on CRT which can be utilized as an image-like light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful. As the heating means, a simple heat plate, iron, heat roller or analogues thereof may be used.

In the present invention, a specific method for forming a color image by heat development comprises heat diffusion transfer of a hydrophilic diffusible dye. For this purpose, the heat-developable color photographic material is composed of a support having thereon a light-sensitive layer (I) containing at least silver halide, an organic silver salt oxidizing agent, a dye releasing redox compound which is also a reducing agent for the organic silver salt oxidizing agent, a hydrophilic binder and a dye releasing activator, and an image receiving layer (II) capable of receiving the hydrophilic diffusible dye formed in the light-sensitive layer (I).

The above described light-sensitive layer (I) and the image receiving layer (II) may be formed on the same support, or they may be formed on different supports, respectively. The image receiving layer (II) can be stripped off the light-sensitive layer (I). For example, after the heat-developable color photographic material is exposed imagewise to light, it is developed by heating uniformly and thereafter the image receiving layer (II) is peeled apart.

In accordance with another process, after the light-sensitive layer (I) is exposed imagewise to light and developed by heating uniformly, the dye can be transferred on the image receiving layer (II) by superposing the image receiving layer on the light-sensitive layer (I) and heating to a temperature lower than the developing temperature. The temperature lower than the developing temperature in such a case includes a room temperature and preferably a temperature from a room temperature to a temperature not less than about 40° C. lower than the heat-developing temperature. For example, a heat-developing temperature and a transferring temperature are 120° C. and 80° C., respectively. Further, there is a method wherein only the light-sensitive layer (I) is exposed imagewise to light and then developed by heating uniformly by superposing the image receiving layer (II) on the light-sensitive layer (I).

The image receiving layer (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing hetero-ring moieties, polymers having quaternary cation groups thereof, having a molecular weight of from 5,000 to 200,000 and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

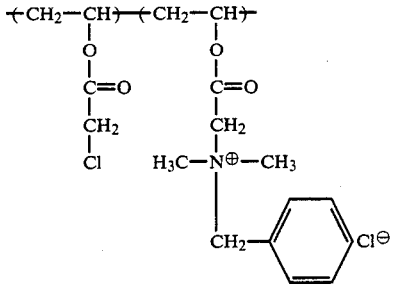

(2) Reaction products between a copolymer of a monomer represented by the general formula described below with another ethylenically unsaturated monomer and a cross-linking agent (for example, bisalkanesulfonate, bisarenesulfonate, etc.):

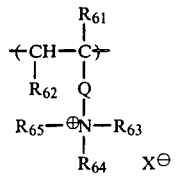

wherein $R_{61}$ represents H or an alkyl group, $R_{62}$ represents H, an alkyl group or an aryl group, Q represents a divalent group, $R_{63}$, $R_{64}$ and $R_{65}$ each represents an alkyl group, an aryl group or at least two or $R_{63}$ to $R_{65}$ are bonded together to form a hetero ring, and X represents an anion. The above described alkyl groups and aryl groups may be substituted.

(3) Polymers represented by the following general formula

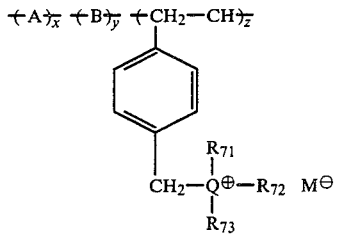

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_{71}$, $R_{72}$ and $R_{73}$ each represents an alkyl group or a cyclic hydrocarbon group or at least two of $R_{71}$ to $R_{73}$ are bonded together to form a ring (these groups and rings may be substituted), and M represents an anion.

(4) Copolymers composed of (a), (b) and (c), wherein (a) is

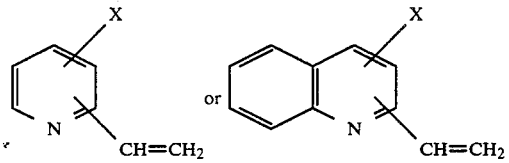

wherein X represents hydrogen, an alkyl group or a halogen atom (the alkyl group may be substituted);

(b) is an acrylic ester; and (c) is acrylonitrile.

(5) Water-insoluble polymers wherein at least ⅓ of the recurring units are those represented by the following general formula

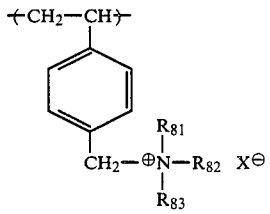

wherein $R_{81}$, $R_{82}$ and $R_{83}$ each represents an alkyl group, with the total number of carbon atoms being 12 or more (the alkyl group may be substituted), and X represents an anion.

Various kinds of known gelatins can be employed as gelatin for the mordant layer. For example, gelatin which is produced in a different manner such as lime-processed gelatin, acid-proceeded gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from about 20/80 to 80/20 (by weight) and the amount of the mordant coated is from 0.5 to 8 g/m$^2$.

The image receiving layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical image receiving materials for diffusion transfer are obtained by mixing the polymer containing ammonium salt groups with gelatin and applying the mixture to a transparent support.

The transfer of dyes from the light-sensitive layer to the image receiving layer can be carried out using a transfer solvent. Preferred examples of useful transfer solvents include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The transfer solvent can be employed by wetting the image receiving layer with the transfer solvent or by incorporating it in the form of water of crystallization or microcapsules into the photographic material.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 3,681,294 and drying in the same manner as used in preparing the heat-developable photographic layer of the present invention, by which the photographic material is obtained.

If necessary, two or more layers may be applied at the same time by the method as described in U.S. Pat. No. 2,761,791 and British Pat. No. 837,095.

The present invention will be explained in greater detail with reference to the following examples, but the present invention should not be construed as being limited thereto.

EXAMPLE 1

40 g of gelatin and 26 g of potassium bromide were dissolved in 3,000 ml of water and the solution was stirred while maintaining the temperature at 50° C. A solution containing 34 g of silver nitrate dissolved in 200 ml of water was added to the above described solution over a period of 10 minutes. Then, a solution containing 3.3 g of potassium iodide dissolved in 100 ml of water was added for a period of 2 minutes. By controlling the pH of the silver iodobromide emulsion thus prepared precipitate was formed and the excess salts were removed. The pH of the emulsion was then adjusted to 6.0 and 400 g of the silver iodobromide emulsion was obtained.

A mixture of 5 g of Dye Releasing Redox Compound A-(42), 0.3 g of Compound (43) according to the present invention, 10 g of tricresyl phosphate, 0.1 g of 2,5-ditertiaryhexylhydroquinone and 30 ml of ethyl acetate was heated at about 60° C. to form a solution. The solution was mixed with 100 g of a 10% aqueous solution of gelatin and 10 ml of a 5% aqueous solution of sodium p-alkylsulfonate (alkyl groups of $C_{12}$ to $C_{13}$) and then dispersed using a homogenizer at 10,000 rpm for 10 minutes. The dispersion thus prepared is designated a dispersion of dye releasing redox compound using compound (43) according to the present invention.

In the following, a method of preparing a light-sensitive coating is described.

(a) a silver iodobromide emulsion: 25 g
(b) a dispersion of Dye Releasing Redox Compound A-(42) using Compound (43) according to the present invention: 33 g
(c) a solution containing 1.5 g of guanidne trichloroacetate dissolved in 15 ml of ethanol
(d) a 5% aqueous solution of the following compound: 10 ml

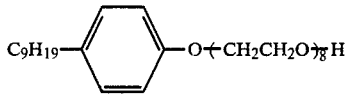

The above-described components (a), (b), (c) and (d) were mixed and dissolved by heating. The solution was coated on a polyethylene terephthalate film at a wet thickness of 60 μm and dried. This sample was designated Sample (A).

Using 1 g of silver salt of Compound (43) according to the present invention, 0.3 g of Compound (14) according to the present invention, 0.3 g of Compound (34) according to the present invention, 0.3 g of Compound (39) according to the present invention and 0.3 g of Compound (48) according to the present invention, respectively, in place of Compound (43) according to the present invention, dispersions of dye releasing redox compounds were prepared and then light-sensitive coating were prepared in the same manner as described for Sample (A). These samples were designated Samples (B) to (F).

Further, in the same manner as described for Sample (A), except without using the compound according to the present invention, a dispersion of Dye Releasing Redox Compound A-(42) and a light-sensitive coating were prepared. Sample (G) was prepared using this light-sensitive coating.

The silver salt of Compound (43) according to the present invention was prepared in the following manner.

20 g of silver nitrate was dissolved in 300 ml of water and to the solution was added with stirring a solution containing 30 g of Compound (43) according to the present invention dissolved in 200 ml of ethanol. After stirring for 1 hour, the white compound thus formed was collected by filtration, washed with water and dried to obtain 40 g of the silver salt of Compound (43).

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinylbenzyl ammonium chloride being 1:1) was dissolved in 200 ml of water and the solution was uniformly mixed with 100 g of a 10% aqueous solution of line process gelatin. The mixture solution was uniformly coated on a polyethylene terephthalate film at a wet thickness of 20 μm and dried to prepare an image receiving material.

Samples (A) to (G) were exposed imagewise at 2,000 lux for 10 seconds using a tungsten lamp and then uniformly heated for 40 seconds on a heat block which had been heated at 130° C. Then, the image receiving material was soaked in water and superposed on the heated Samples (A) to (G) so as to bring into contact with each of the surface layers, and they were passed through a heat roller at 80° C. The image receiving material was peeled apart from Samples (A) to (G) thereby a negative magenta color image was obtained on the image receiving material. The maximum density ($D_{max}$) and the minimum density ($D_{min}$) of the negative image to green light were measured using a Macbeth transmission densitometer (TD-504). The results thus obtained are shown in Table 1 below.

TABLE 1

| Sample No. | Compound | Magenta Color Image $D_{max}$ | Magenta Color Image $D_{min}$ |
|---|---|---|---|
| A | (43) | 2.18 | 0.12 |
| B | Silver Salt of (43) | 2.12 | 0.14 |
| C | (14) | 2.14 | 0.18 |
| D | (34) | 2.08 | 0.16 |
| E | (39) | 2.15 | 0.13 |
| F | (48) | 2.13 | 0.15 |
| G | — | 2.10 | 0.32 |

From the results shown in Table 1 above, it is apparent that the $D_{min}$ is remarkably decreased without the decrease in the $D_{max}$ when the compounds according to the present invention were used.

EXAMPLE 2

A dispersion of Dye Releasing Redox Compound A-(48) was prepared in the same manner as described in Example 1 except using 5 g of Dye Releasing Redox Compound A-(48) in place of Dye Releasing Redox Compound A-(42) and without using Compound (43) according to the present invention.

In the following, a method of preparing a light-sensitive coating is described.

(a) a silver iodobromide emulsion (same as used in Example 1): 25 g
(b) a dispersion of Dye Releasing Redox Compound A-(48): 33 g
(c) a solution containing 1.5 g of guanidne trichloroacetate dissolved in 15 ml of ethanol
(d) a 5% aqueous solution of the following compound: 10 ml

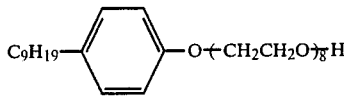

(e) a solution containing 0.05 g of Compound (41) according to the present invention dissolved in 5 ml of methanol The above-described components (a), (b), (c) (d) and (e) were mixed and a light-sensitive coating was prepared in the same manner as described in Example 1. Sample (H) was prepared using this light-sensitive coating.

Samples (I) to (K) were prepared in the same manner as described for Sample (H) except using the compounds shown in Table 2 below in place of Compound (41) according to the present invention, respectively.

The image receiving material and the treatment were employed in the same manner as described in Example 1 whereby the results shown in Table 2 below were obtained.

TABLE 2

| Sample No. | Compound | Color Image $D_{max}$ | Color Image $D_{min}$ |
|---|---|---|---|
| H (Present Invention) | (41) | 2.10 | 0.14 |
| I (Comparison) | 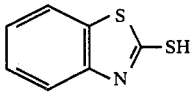 | 1.03 | 0.30 |
| J (Comparison) | 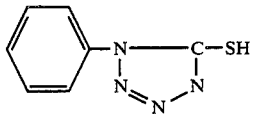 | 0.96 | 0.28 |
| K (Comparison) | none | 2.21 | 0.34 |

From the results shown in Table 2 above, it is apparent that the $D_{min}$ is remarkably decreased without the decrease in the $D_{max}$ when the compound according to the present invention was used.

EXAMPLE 3

In the following, examples in which an organic silver salt oxidizing agent is used are described.

Preparation of Silver Benzotriazole Emulsion 28 g of gelatin and 13:2 g of benzotriazole were dissolved in 3,000 ml of water and the solution was stirred while maintaining it at 40° C. A solution containing 17 g of silver nitrate dissolved in 100 ml of water was added to the above described solution for a period of 2 minutes. By controlling a pH of the silver benzotriazole emulsion thus prepared to precipitate and the excess salts were removed. The pH of the emulsion was then adjusted to 6.0 and 400 g of the silver benzotriazole emulsion was obtained.

Using the silver benzotriazole emulsion thus prepared, a light-sensitive coating was prepared in the following manner.

(a) a silver iodobromide emulsion (same as used in Example 1): 20 g
(b) a silver benzotriazole emulsion: 10 g
(c) a dispersion of Dye Releasing Redox Compound A-(42) using Compound (43) according to the present invention (Same as used in Example 1): 33 g
(d) a solution containing 1.5 g of guanidine trichloroacetate dissolved in 20 ml of ethanol
(e) a 5% aqueous solution of the following compound: 10 ml

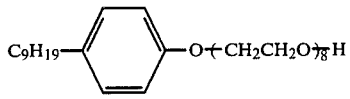

The above-described components (a), (b), (c), (d) and (e) were mixed and dissolved by heating. The solution was coated on a polyethylene terephthalate film at a wet thickness of 60 μm and dried. The sample thus prepared was designated Sample (L).

Further, Samples (M) and (N) were prepared in the same manner as described for Sample (L) except for using the dispersions used in Samples (C) and (G) in Example 1 in place of the dispersion of Dye Releasing Redox Compound A-(42) as a component (c).

Samples (L), (M) and (N) were subjected to exposure to light, heat development and transfer in the same manner as described in Example 1. The results obtained are shown in Table 3 below.

TABLE 3

| Sample No. | Compound | Color Image $D_{max}$ | Color Image $D_{min}$ |
|---|---|---|---|
| L (Present Invention) | (43) | 2.28 | 0.11 |
| M (Present Invention) | (14) | 2.32 | 0.17 |
| N (Present Invention) | none | 2.30 | 0.25 |

It is apparent from the results shown in Table 3 above that the $D_{min}$ is remarkably decreased without the decrease in the $D_{max}$ when the compounds according to the present invention were used.

EXAMPLE 4

Sample (X) and Sample (Y) were prepared in the same manner as described for Sample H in Example 2 of the present application except using Compound (50) in Sample (X) and Compound (2) in Sample (Y) in the same amount as Compound (41) in place of Compound (41), respectively.

The image receiving material and the treatment of Example 1 were employed in the same manner as in Example 1, whereby the results shown in Table 4 below were obtained.

TABLE 4

| Sample No. | Compound | Color Image $D_{max}$ | Color Image $D_{min}$ |
|---|---|---|---|
| X | 50 | 2.01 | 0.17 |
| Y | 20 | 2.00 | 0.17 |

While the invention has been described in detail and with reference to specific embodiment thereof, it will be apparent to one skilled in the art that various changes and modification can be made therein without departing from the spirit and scope thereof.

What is claimed is:

1. A heat-developable color photographic material comprising a support having thereon at least a light-sensitive silver halide, a hydrophilic binder, a dye releasing redox compound capable of releasing a hydrophilic dye and a compound represented by the following general formula (IIA):

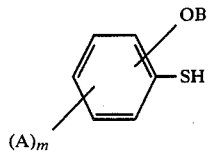

(IIA)

wherein B represents an alkyl group or a substituted alkyl group; m represents 0 or an integer of 1 to 4; and A represents an alkyl group, an alkoxy group, an aryloxy group, an alkoxycarbonyl group, an acylamino group, a sulfonylamino group or a halogen atom and when m represents 2 or more A may be the same or different.

2. A heat-developable color photographic material as claimed in claim 1, wherein the dye releasing redox compound capable of releasing a hydrophilic dye is represented by the following general formula (XI)

$$R—SO_2—D \quad (XI)$$

wherein R represents a reducing group capable of being oxidized by the silver halide; and D represents an image forming dye portion containing a hydrophilic group.

3. A heat-developable color photographic material as claimed in claim 2, wherein the hydrophilic group included in the dye portion represented by D is a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group or an alkoxyalkoxy group.

4. A heat-developable color photographic material as claimed in claim 1, wherein the color photographic material further contains a reducing agent for reducing a silver halide and/or an organic silver salt oxidizing agent.

5. A heat-developable color photographic material as claimed in claim 1, wherein the color photographic material further contains an organic silver salt oxidizing agent, wherein the light-sensitive silver halide and the organic silver salt oxidizing agent are present in the same layer.

6. A heat-developable color photographic material as claimed in claim 1, wherein the hydrophilic binder is gelatin or a gelatin derivative.

7. A heat-developable color photographic material as claimed in claim 1, wherein the color photographic material further contains a dye releasing activator.

8. A heat-developable color photographic material as claimed in claim 7, wherein the dye releasing activator is a base, a base releasing agent or a water releasing compound.

9. A heat-developable color photographic material as claimed in claim 1, wherein the color photograpic material further contains a thermal solvent.

10. A method of forming a color image, comprising the steps of:

imagewise exposing and heating a heat-developable color photographic material comprising a support having thereon a light-sensitive silver halide, a hydrophilic binder, a dye releasing redox compound capable of releasing a hydrophilic dye and a compound represented by the general formula (IIA):

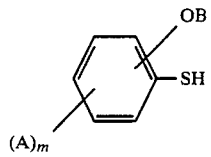

(IIA)

wherein B represents an alkyl group or a substituted alkyl group; m represents 0 or an integer of 1 to 4; and A represents an alkyl group, an alkoxy group, an aryloxy group, an alkoxycarbonyl group, an acylamino group, a sulfonylamino group or a halogen atom and when m represents 2 or more A may be the same or different, thereafter the hydrophilic dye being imagewise transferred to an image receiving layer.

11. A method of forming a color image as claimed in claim 10, wherein the hydrophilic diffusible dye is transferred in the presence of a transfer solvent.

12. A method of forming a color image as claimed in claim 10, wherein the hydrophilic diffusible dye is transferred by heating at a temperature lower than the developing temperature.

13. A method of forming a color image as claimed in claim 10, wherein the image receiving layer contains a mordant for the hydrophilic diffusible dye.

14. A method of forming a color image as claimed in claim 11, wherein the transfer solvent is present in the image receiving layer.

15. A heat-developable color photographic material as claimed in claim 1, wherein the compound represented by general formula (IIA) has the formula:

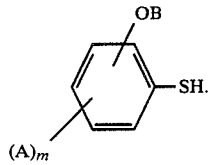

16. A heat-developable color photographic material as claimed in claim 1, wherein the compound represented by general formula (IIA) has the formula:

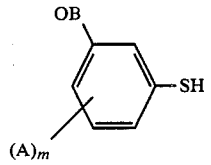

17. A heat-developable color photographic material as claimed in claim 1, wherein the compound represented by general formula (IIA) has the formula:

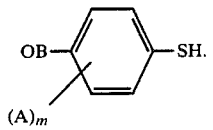

18. A method of forming a color image as claimed in claim 10, wherein said compound of general formula (IIA) has the formula:

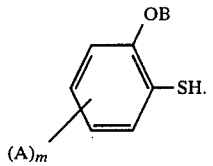

19. A method of forming a color image as claimed in claim 10, wherein said compound of general formula (IIA) has the formula:

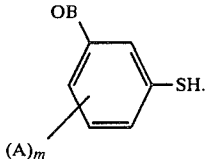

20. A method of forming a color image as claimed in claim 10, wherein said compound of general formula (IIA) has the formula:

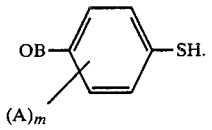

21. A method of forming a color image as claimed in claim 10, wherein B is said alkyl group and A is said alkyl group.

22. A method of forming a color image as claimed in claim 10, wherein B is said substituted alkyl group and A is said halogen.

* * * * *